US012741354B2

(12) United States Patent
Namiki

(10) Patent No.: US 12,741,354 B2
(45) Date of Patent: Sep. 22, 2026

(54) POLISHING PAD, POLISHING APPARATUS, AND POLISHING METHOD

(71) Applicant: EBARA CORPORATION, Tokyo (JP)

(72) Inventor: Keisuke Namiki, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 413 days.

(21) Appl. No.: 18/553,127

(22) PCT Filed: Feb. 17, 2022

(86) PCT No.: PCT/JP2022/006388
§ 371 (c)(1),
(2) Date: Sep. 28, 2023

(87) PCT Pub. No.: WO2022/209389
PCT Pub. Date: Oct. 6, 2022

(65) Prior Publication Data

US 2024/0189959 A1 Jun. 13, 2024

(30) Foreign Application Priority Data

Apr. 2, 2021 (JP) ..... 2021-063308

(51) Int. Cl.
*B24B 37/013* (2012.01)
*B24B 37/20* (2012.01)

(52) U.S. Cl.
CPC ..... *B24B 37/013* (2013.01); *B24B 37/205* (2013.01)

(58) Field of Classification Search
CPC ..... B24B 37/013; B24B 37/205; B24B 37/22; B24B 37/24; B24B 37/245; B24D 11/00;
(Continued)

(56) References Cited

U.S. PATENT DOCUMENTS 5,964,413 A * 10/1999 Mok ..... B24B 37/04 239/231
2002/0006770 A1* 1/2002 Bachand ..... B24B 37/013 451/56

(Continued)

FOREIGN PATENT DOCUMENTS

JP 2001-062703 A 3/2001
JP 2007-083387 A 4/2007

(Continued)

OTHER PUBLICATIONS

The National Institute of Advanced Industrial Science and Technology (AIST), "Materials Able to be Repeatedly Liquefied and Solidified at Room Temperature by Light Irradiation—Reusable by fluidizing and hardening without the application of heat," Press Release (Apr. 6, 2012).

(Continued)

*Primary Examiner* — Joel D Crandall
(74) *Attorney, Agent, or Firm* — Leydig, Voit & Mayer, Ltd.

(57) ABSTRACT

The present invention relates to a polishing pad and a polishing apparatus for use in polishing of a substrate, such as a wafer. Further, the present invention relates to a method of polishing a substrate, such as a wafer. At least a part of the polishing pad (30) is made of a light transmissive material (34) and a light reactive material (35). The light reactive material (35) is mixed into the light transmissive material (34).

24 Claims, 25 Drawing Sheets

(58) Field of Classification Search
CPC ..... B24D 11/001; B24D 11/02; B24D 11/04; B24D 3/32
See application file for complete search history.

(56) References Cited

U.S. PATENT DOCUMENTS

| | | | | |
|---|---|---|---|---|
| 2007/0049166 | A1* | 3/2007 | Yamaguchi | B24B 37/345 451/8 |
| 2008/0014532 | A1* | 1/2008 | Kessel | H01L 21/6835 430/311 |
| 2012/0009847 | A1* | 1/2012 | Menk | B24B 37/005 451/5 |
| 2012/0178349 | A1* | 7/2012 | Kim | B24B 37/26 451/526 |
| 2015/0044951 | A1* | 2/2015 | Bajaj | B24B 37/245 451/526 |

FOREIGN PATENT DOCUMENTS

| | | | |
|---|---|---|---|
| JP | 2008-546551 | A | 12/2008 |
| JP | 2013-018079 | A | 1/2013 |
| JP | 2019-026817 | A | 2/2019 |

OTHER PUBLICATIONS

Japan Patent Office, International Search Report in International Patent Application No. PCT/JP2022/006388 (Apr. 26, 2022).

* cited by examiner

POLISHING PAD, POLISHING APPARATUS, AND POLISHING METHOD

TECHNICAL FIELD

The present invention relates to a polishing pad and a polishing apparatus for use in polishing of a substrate, such as a wafer. Further, the present invention relates to a method of polishing a substrate, such as a wafer.

BACKGROUND ART

With a recent trend toward higher integration and higher density in semiconductor devices, circuit interconnects become finer and finer and the number of levels in multilayer interconnect is increasing. In the process of achieving the multilayer interconnect structure with finer interconnects, film coverage of step geometry (or step coverage) is lowered through thin film formation as the number of interconnect levels increases, because surface steps grow while following surface irregularities on a lower layer. Therefore, in order to fabricate the multilayer interconnect structure, it is necessary to improve the step coverage and planarize the surface in an appropriate process. Further, since finer optical lithography entails shallower depth of focus, it is necessary to planarize surfaces of semiconductor device so that irregularity steps formed thereon fall within a depth of focus in optical lithography.

Accordingly, in a manufacturing process of the semiconductor devices, a planarization technique for a surface of the semiconductor device is becoming more important. The most important technique in this planarization technique is chemical mechanical polishing (CMP). This chemical mechanical polishing (which will be hereinafter called CMP) is a process of polishing a substrate, such as a wafer, by placing the substrate in sliding contact with a polishing surface of a polishing pad while supplying a polishing liquid containing abrasive grains, such as silica ($SiO_2$), onto the polishing pad. A polishing apparatus for performing CMP includes a polishing table that supports a polishing pad having a polishing surface, and a polishing head for holding the substrate. This polishing apparatus polishes the substrate as follows. The polishing head holds the substrate and presses the substrate against the polishing surface of the polishing pad at a predetermined pressure. Further, the substrate is in sliding contact with the polishing surface by the relative motion between the polishing table and the polishing head, so that the substrate is polished to have a flat and mirror surface.

The polishing head includes a retainer ring in order to prevent the substrate from slipping out a substrate holding device during polishing of the substrate. This retainer ring is arranged so as to surround the substrate, and presses the polishing pad outside the substrate. The retainer ring has a function of controlling an amount of rebounding of the polishing pad, i.e., pressure of the retainer ring on the polishing pad, to thereby control a polishing rate of a periphery of the substrate, in addition to a function of preventing the substrate from slipping out the polishing head during polishing of the substrate.

CITATION LIST

Patent Literature

Patent document 1: Japanese laid-open patent publication No. 2008-546551

Patent document 2: Japanese laid-open patent publication No. 2001-62703

Patent document 3: Japanese laid-open patent publication No. 2007-83387

SUMMARY OF INVENTION

Technical Problem

However, the polishing pad is worn as a substrate is repeatedly polished and a dressing operation for regenerating the polishing surface of the polishing pad is repeatedly performed. As the polishing pad becomes thinner, a rigidity of the polishing pad changes and a polishing profile (specifically, a profile of ratio of a change in a polishing rate of a substrate to a change in pressure of the retainer ring) also changes. This results in a change in a position where the polishing rate can be controlled by regulating the pressure of the retainer ring. In addition, an amount of change in the polishing rate per unit pressure is also changed. As a result, it becomes difficult to accurately control the polishing rate of the periphery of the substrate.

FIG. 25A is a diagram illustrating a conventional polishing pad constituted of an upper layer 131 and a lower layer 132 when being pressed by a retainer ring 115 while a substrate Wf is polished. FIG. 25B is a diagram illustrating the polishing pad in which wear of the upper layer 131 is more advanced than the polishing pad in FIG. 25A. As shown in FIGS. 25A and 25B, as the wear of the polishing pad progresses, a deformation range of the polishing pad due to being pressed by the retainer ring narrows. As a result, an edge-profile responsive region, i.e., a region where the polishing rate can be controlled by regulating pressure of the retainer ring, narrows.

FIG. 26A is a diagram showing a polishing profile of the substrate Wf when the substrate Wf is polished with the polishing pad shown in FIG. 25A, and FIG. 26B is a diagram showing a polishing profile of the substrate Wf when the substrate Wf is polished with the polishing pad shown in FIG. 25B. Vertical axis in each diagram indicates an amount of change in polishing rate per unit pressure of the retainer ring, and horizontal axis in each diagram indicates a position from the center of the substrate. As shown in FIGS. 26A and 26B, as the polishing pad is worn, a position of a significant change in the polishing rate is changed.

The present invention has been made in view of the above drawback. It is therefore an object of the present invention to provide a polishing pad, a polishing apparatus, and a polishing method capable of compensating for change in rigidity due to change in a thickness of a polishing pad.

Solution to Problem

In an embodiment, there is provided a polishing pad having a polishing surface for polishing a substrate, comprising: a light transmissive material; and a light reactive material mixed into the light transmissive material, at least a part of the polishing pad being made of the light transmissive material and the light reactive material.

In an embodiment, the light reactive material is configured to reversibly change its state depending on a wavelength of light directed to the light reactive material.

In an embodiment, the light reactive material comprises an ultraviolet-curable resin.

In an embodiment, the light transmissive material is configured to be able to pass light having a wavelength in a range from a wavelength of ultraviolet light to a wavelength of visible light.

In an embodiment, the light transmissive material comprises resin including a base material which is one or a mixture of two or more of acrylic resin, polyethylene terephthalate, polycarbonate, olefin resin, fluorine resin, nylon, and polyurethane. In an embodiment, the polishing pad comprises a light reactive layer having a physical property that changes in response to light, at least a part of the light reactive layer being made of the light transmissive material and the light reactive material.

In an embodiment, the polishing pad further comprises a polishing layer having the polishing surface, the light reactive layer being coupled to the polishing layer.

In an embodiment, the polishing pad further comprises a cushion layer having a plurality of through-holes formed therein, the cushion layer being coupled to the light reactive layer.

In an embodiment, the polishing pad further comprises a cushion layer, wherein the light reactive layer has the polishing surface, and the cushion layer is coupled to the light reactive layer.

In an embodiment, the light reactive layer has a first light-transmissive surface facing away from the polishing surface, and the light reactive material is distributed in a central region in a thickness direction of the light reactive layer or distributed in a biased manner toward the first light-transmissive surface.

In an embodiment, there is provided a polishing apparatus for polishing a substrate, comprising: a polishing-pad structure; a polishing table configured to support the polishing-pad structure; a polishing head configured to press the substrate against the polishing-pad structure; and a light source configured to emit light to the polishing-pad structure, wherein the polishing-pad structure includes a polishing pad having a polishing surface for polishing the substrate, and at least a part of the polishing-pad structure is made of a light transmissive material and a light reactive material, the light reactive material being mixed into the light transmissive material.

In an embodiment, the polishing pad comprises the above-mentioned polishing pad.

In an embodiment, the polishing-pad structure includes a light reactive sheet configured to change its physical property in response to light, and at least a part of the light reactive sheet is made of the light transmissive material and the light reactive material.

In an embodiment, the light reactive material is configured to reversibly change its state depending on a wavelength of light directed to the light reactive material.

In an embodiment, the light reactive material comprises an ultraviolet-curable resin.

In an embodiment, the light source is configured to be able to change a wavelength of the light in at least a range of a wavelength of ultraviolet light to a wavelength of visible light, or the light source is configured to emit ultraviolet light.

In an embodiment, the light source is disposed in the polishing table or above the polishing table.

In an embodiment, the polishing table includes a support plate configured to support the polishing-pad structure, and the support plate is made of transparent ceramic or quartz glass.

In an embodiment, a part of the polishing apparatus is covered with a coating layer that blocks or absorbs ultraviolet light.

In an embodiment, the coating layer contains an ultraviolet blocking agent, and the ultraviolet blocking agent comprises carbon black or inorganic pigment.

In an embodiment, a part of the polishing apparatus is made of plastic material that hardly absorbs ultraviolet light.

In an embodiment, the plastic material comprises one of polymethyl methacrylate, polycarbonate, polyvinyl chloride, and polytetrafluoroethylene.

In an embodiment, the polishing apparatus further comprises a rigidity measuring device configured to measure a rigidity of the polishing pad.

In an embodiment, the polishing apparatus further comprises a thickness measuring device configured to measure a thickness of the polishing pad.

In an embodiment, the polishing apparatus further comprises an operation controller configured to count the number of processed substrates after replacement of the polishing pad.

In an embodiment, there is provided a polishing method comprising: setting a wavelength of light, an intensity of light, or an irradiation time of light to an initial set value, and directing the light, emitted by a light source, to a polishing-pad structure having a polishing pad for polishing a substrate, at least a part of the polishing-pad structure being made of a light transmissive material and a light reactive material, the light reactive material being mixed into the light transmissive material, the polishing-pad structure being supported by a polishing table; pressing the substrate by a polishing head against a polishing surface of the polishing pad while independently rotating the polishing head and the polishing table to polish the substrate; measuring a physical quantity indirectly indicating a rigidity of the polishing pad after termination of the polishing; calculating a difference between a target value of the physical quantity and a measured value of the physical quantity; comparing the difference with a predefined physical-quantity reference range; when the difference is out of the physical-quantity reference range, calculating an optimum value of the wavelength of the light, the intensity of the light, or the irradiation time of the light based on a correlation between the physical quantity and one of the wavelength of the light, the intensity of the light, and the irradiation time of the light, and changing the wavelength of the light, the intensity of the light, or the irradiation time of the light to the optimum value; and when the physical quantity is within the physical-quantity reference range, polishing the substrate, wherein the target value of the physical quantity is a value of the physical quantity when the light is directed to the polishing-pad structure under a condition that the wavelength of the light, the intensity of the light, or the irradiation time of the light has the initial set value.

In an embodiment, the physical quantity is a size of a deformed region of the polishing pad created by a pad pressing mechanism, a thickness of the polishing pad, the number of processed substrates, or an accumulated time of dressing.

In an embodiment, the polishing method further comprises creating a profile of a polishing rate of a monitoring substrate; and determining the initial set value of the wavelength of the light, the intensity of the light, or the irradiation time of the light which is optimal for flattening the profile of the polishing rate of the monitoring substrate based on a correlation between a wavelength and a polishing profile, a correlation between an intensity of light and a polishing profile, or a correlation between an irradiation time of light and a polishing profile obtained in advance.

Advantageous Effects of Invention

According to the present invention, at least a part of the polishing pad is made of the light transmissive material and the light reactive material, the light reactive material being mixed into the light transmissive material. As a result, a change in rigidity of the polishing pad due to a change in thickness of the polishing pad can be compensated.

Further, according to the present invention, at least a part of the polishing-pad structure is made of the light transmissive material and the light reactive material, the light reactive material being mixed into the light transmissive material. As a result, a change in rigidity of the polishing pad due to a change in thickness of the polishing pad can be compensated.

DESCRIPTION OF EMBODIMENTS

Figure 1:
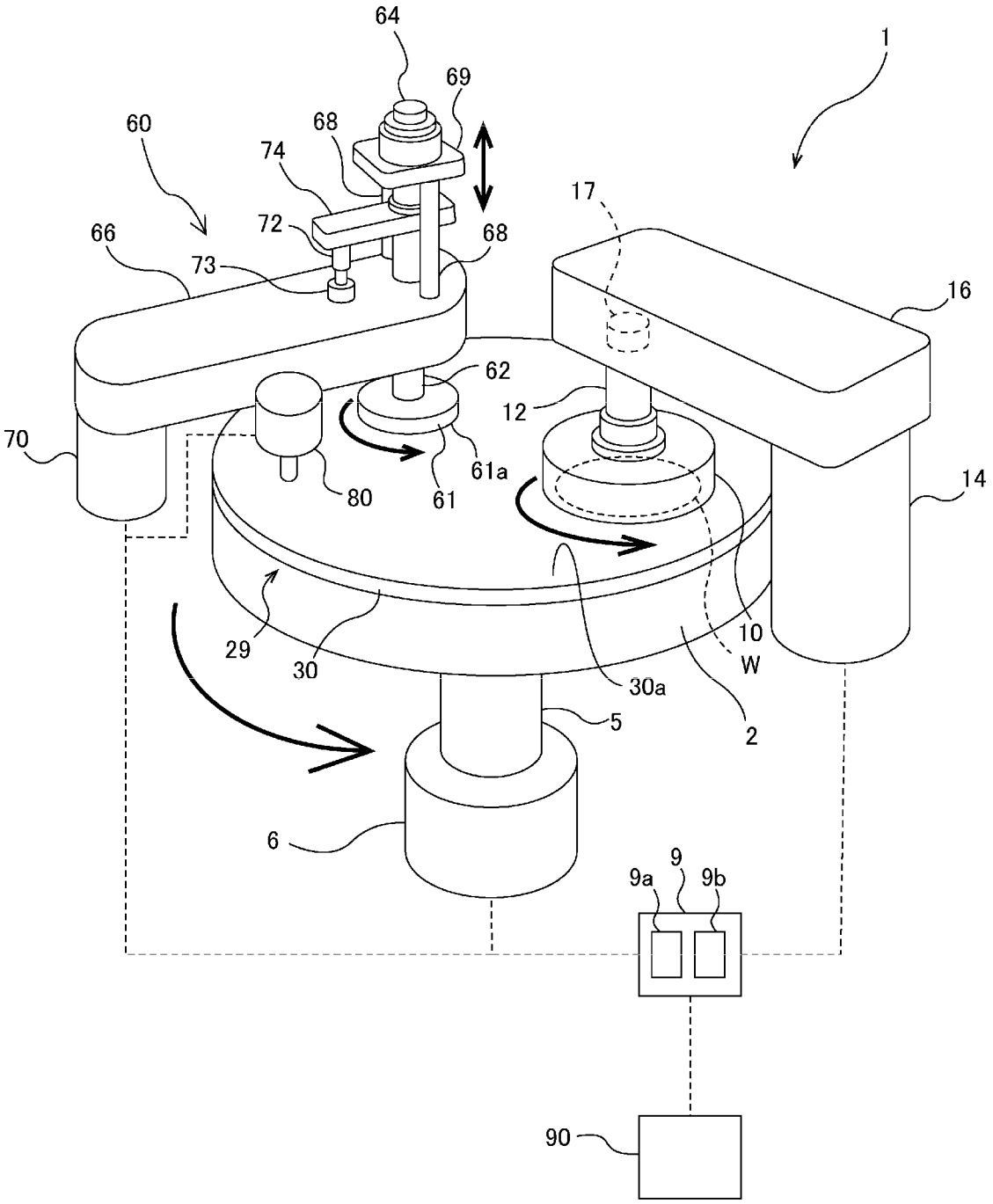
FIG. 1 is a schematic diagram showing an embodiment of a polishing apparatus.

Hereinafter, embodiments of the present invention will be described with reference to the drawings. FIG. 1 is a schematic diagram showing an embodiment of a polishing apparatus. As shown in FIG. 1, a polishing apparatus 1 configured to polish a substrate W, such as a wafer, includes a polishing-pad structure 29, a polishing table 2 configured to support the polishing-pad structure 29, a polishing head 10 configured to press the substrate W, such as a wafer, against the polishing-pad structure 29, and an operation controller 9. The polishing-pad structure 29 includes a polishing pad 30 having a polishing surface 30*a* for polishing the substrate W. The polishing head 10 presses the substrate W against the polishing surface 30*a* of the polishing pad 30 during polishing of the substrate W. The polishing pad 30 is attached to a surface of the polishing table 2 with the polishing surface 30*a* facing upward. The polishing surface 30*a* has a minute asperity structure for polishing the substrate W.

The polishing apparatus 1 further includes a support shaft 14, a polishing-head oscillation arm 16 coupled to an upper end of the support shaft 14, and a polishing-head shaft 12 attached to a free end of the polishing-head oscillation arm 16. The polishing head 10 is coupled to a lower end of the polishing-head shaft 12. The polishing-head shaft 12 is coupled to a polishing-head motor 17 disposed in the polishing-head oscillation arm 16. The polishing-head motor 17 rotates the polishing head 10 together with the polishing-head shaft 12 in a direction indicated by an arrow.

The polishing-head shaft 12 can vertically move relative to the polishing-head oscillation arm 16 by a not-shown elevating mechanism, so that the polishing head 10 is able to vertically move relative to the polishing-head oscillation arm 16 by the vertical movement of the polishing-head shaft 12. The polishing head 10 is configured to be able to hold the substrate W on its lower surface. The polishing head oscillating arm 16 is configured to be able to oscillate about the support shaft 14. The polishing head 10 holding the substrate W moves between a not-shown receiving position for the substrate W and a position above the polishing table 2 by the oscillation of the polishing head oscillating arm 16.

The polishing table 2 is coupled to a table rotating motor 6, which is arranged below a table shaft 5 via the table shaft 5. The table rotating motor 6 rotates the polishing table 2 and the polishing-pad structure 29 supported by the polishing table 2 about the table shaft 5 in a direction indicated by an arrow. The rotating directions of the polishing head 10 and the polishing table 2 are not limited to this embodiment. In one embodiment, the polishing head 10 and polishing table 2 may be configured to rotate in directions opposite to the directions indicated by the arrows in FIG. 1.

The operation controller 9 includes a memory 9*a* storing programs therein, and a processor 9*b* configured to perform arithmetic operations according to instructions contained in the programs. The processor 9*b* includes a CPU (central processing unit), a GPU (graphic processing unit), or the like configured to perform arithmetic operations according to the instructions contained in the programs stored in the memory 9*a*. The memory 9*a* includes a main memory (e.g., a random access memory) accessible by the processor 9*b*, and an auxiliary memory (e.g., a hard disk drive or a solid state drive) storing data and programs therein. The operation controller 9 is composed of at least one computer. However, the specific configuration of the operation controller 9 is not limited to this example. Each component of the polishing apparatus 1 is electrically connected to the operation controller 9, and operations of each component of the polishing apparatus 1 are controlled by the operation controller 9.

Figure 2:
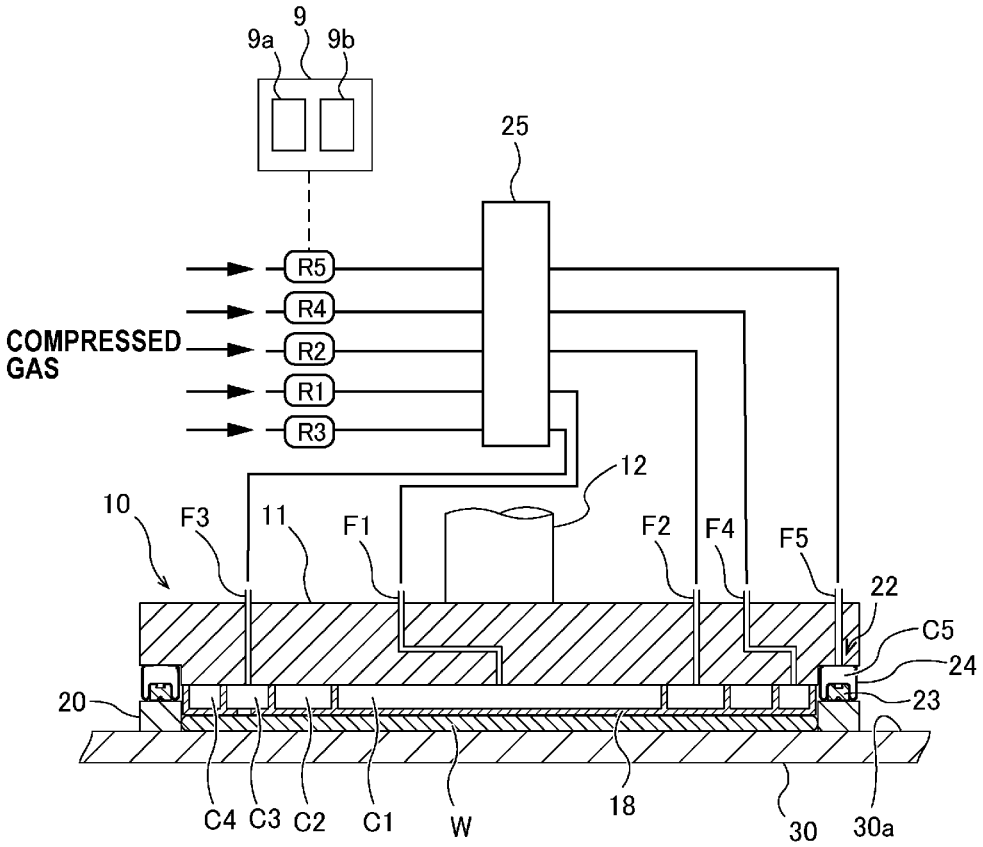
FIG. 2 is a cross-sectional view of a polishing head shown in FIG. 1.

FIG. 2 is a cross-sectional view of the polishing head 10 shown in FIG. 1. The polishing head 10 includes a head body 11 fixed to the end of the polishing-head shaft 12, a membrane (elastic membrane) 18 attached to a lower portion of the head body 11, and a retainer ring 20 arranged below the head body 11. The retainer ring 20 is arranged around the membrane 18, and is an annular structure configured to retain the periphery of the substrate W so as to prevent the substrate W from slipping out from the polishing head 10 during polishing of the substrate W. The retainer ring 20 presses the polishing pad 30 outside the substrate W during polishing of the substrate W.

Four pressure chambers C1, C2, C3, and C4 are provided between the membrane 18 and the head body 11. The pressure chambers C1, C2, C3, and C4 are formed by the membrane 18 and the head body 11. The central pressure chamber C1 has a circular shape, while the other pressure chambers C2, C3, and C4 have annular shapes. These pressure chambers C1, C2, C3, and C4 are concentrically arranged.

Gas delivery lines F1, F2, F3, and F4 are coupled to the pressure chambers C1, C2, C3, and C4, respectively. One ends of the gas delivery lines F1, F2, F3, and F4 are coupled to a compressed-gas supply source (not shown) which is a utility provided in a factory where the polishing apparatus is installed. Compressed gas, such as compressed air, is supplied into the pressure chambers C1, C2, C3, and C4 through the gas delivery lines F1, F2, F3, and F4, respectively.

The gas delivery lines F1, F2, F3, and F4 communicating with the pressure chambers C1, C2, C3, and C4, respectively, are coupled to not-shown vacuum lines, respectively, so that a vacuum can be formed in each of the pressure chambers C1, C2, C3, and C4. The membrane 18 has an opening in a portion that forms the pressure chamber C3, so that the substrate W can be held by the polishing head 10 via vacuum suction by producing a vacuum in the pressure chamber C3. Further, the substrate W can be released from the polishing head 10 by supplying the compressed gas into the pressure chamber C3.

An annular retainer-ring pressing mechanism 22 is disposed between the head body 11 and the retainer ring 20. An upper portion of the retainer ring 20 is coupled to the retainer-ring pressing mechanism 22. The retainer-ring pressing mechanism 22 applies a uniform downward load to the entire upper surface of the retainer ring 20 to thereby press a lower surface of the retainer ring 20 against the polishing surface 30*a* of the polishing pad 30.

The retainer-ring pressing mechanism 22 includes an annular piston 23 coupled to the upper portion of the retainer ring 20, and an annular rolling diaphragm 24 coupled to an upper surface of the piston 23. A pressure chamber C5 is formed inside the rolling diaphragm 24. The pressure chamber C5 is coupled to the compressed-gas supply source via a gas delivery line F5. The compressed gas is supplied into the pressure chamber C5 through the gas delivery line F5.

When the compressed gas is supplied from the compressed-gas supply source into the pressure chamber C5, the rolling diaphragm 24 pushes the piston 23 downward, and the piston 23 in turn pushes the entire retainer ring 20 downward. In this manner, the retainer-ring pressing mechanism 22 presses the lower surface of the retainer ring 20 against the polishing surface 30*a* of the polishing pad 30. The retainer ring 20 is removably coupled to the retainer-ring pressing mechanism 22.

The gas delivery lines F1, F2, F3, F4, and F5 extend through a rotary joint 25 attached to the polishing-head shaft 12. Pressure regulators R1, R2, R3, R4, and R5 are attached to the gas delivery lines F1, F2, F3, F4, and F5 communicating with the pressure chambers C1, C2, C3, C4, and C5, respectively. The compressed gas from the compressed-gas supply source is independently supplied into the pressure chambers C1 to C5 through the pressure regulators R1 to R5. The pressure regulators R1 to R5 are configured to regulate pressures of the compressed gas in the pressure chambers C1 to C5. The pressure regulators R1 to R5 are coupled to the operation controller 9, and operations of the pressure regulators R1 to R5 are controlled by the operation controller 9.

The pressure regulators R1 to R5 can change the internal pressures of the pressure chambers C1 to C5 independently of each other. Thus, polishing pressures on four corresponding regions of the substrate W (i.e., a central portion, an inner intermediate portion, an outer intermediate portion, and an edge portion) and a pressing force of the retainer ring 20 against the polishing pad 30 can be independently regulated. The gas delivery lines F1, F2, F3, F4, and F5 are also coupled to vent valves (not shown), respectively, so that the pressure chambers C1 to C5 can communicate with the atmosphere.

Polishing of the substrate W is performed as follows. A polishing liquid, such as slurry, is supplied onto the polishing surface 30*a* of the polishing pad 30 from a polishing-liquid supply nozzle (not shown) provided above the polishing table 2, while the polishing head 10 and the polishing table 2 are independently rotating in the directions indicated by the arrows in FIG. 1. The polishing head 10 is lowered to a predetermined polishing position by the elevating mechanism (not shown). When the compressed gas is supplied into the pressure chambers C1 to C4 of the polishing head 10 located at this polishing position, the membrane 18 is inflated to press the substrate W against the polishing surface 30*a* of the polishing pad 30.

The compressed gas is also supplied into the pressure chamber C5, so that the retainer-ring pressing mechanism 22 presses the retainer ring 20 against the polishing surface 30*a* of the polishing pad 30. The substrate W is pressed against the polishing surface 30*a* of the polishing pad 30 in the presence of the polishing liquid on the polishing pad 30 while the substrate W is rotated by the polishing head 10. A surface of the substrate W is polished by a chemical action of the polishing liquid and a mechanical action of the abrasive grains contained in the polishing liquid or the polishing pad 30.

Referring back to FIG. 1, the polishing apparatus 1 further includes a dressing unit 60 configured to dress the polishing surface 30*a* of the polishing pad 30. The dressing unit 60 includes a dresser 61 to be brought into sliding contact with the polishing surface 30*a* of the polishing pad 30, a dresser shaft 62 coupled to the dresser 61, an air cylinder 64 provided at an upper end of the dresser shaft 62, and a dresser oscillation arm 66 rotatably supporting the dresser shaft 62. A lower surface of the dresser 61 constitutes a dressing surface 61*a*, which is constituted by abrasive grains (e.g., diamond particles). The air cylinder 64 is disposed on a support base 69 supported by columns 68 which are secured to the dresser oscillation arm 66.

When a not-shown motor coupled to a support shaft 70 is driven, the dresser oscillation arm 66 pivots about the support shaft 70. The dresser shaft 62 is rotated by a not-shown dresser motor disposed in the dresser oscillation arm 66. This rotation of the dresser shaft 62 causes the dresser 61 to rotate about the dresser shaft 62 in a direction indicated by an arrow in FIG. 1. The air cylinder 64 is coupled to the dresser 61 via the dresser shaft 62. The air cylinder 64 vertically moves the dresser shaft 62 and the dresser 61 together to press the dressing surface 61*a* of the dresser 61 against the polishing surface 30*a* of the polishing pad 30 at a predetermined pressing force.

The dressing surface 61*a* of the dresser 61 is pressed against the polishing surface 30*a* by the air cylinder 64 while the polishing pad 30 is rotating together with the polishing table 2 and the dresser 61 is rotating about the dresser shaft 62. As a result, the polishing pad 30 is scraped, so that the polishing surface 30*a* is dressed (regenerated).

The dressing unit 60 further includes a dresser displacement sensor 72 configured to measure a height of the dresser 61 (i.e., a vertical position of the dresser 61), a target plate 73, and a sensor holder 74. The sensor holder 74 is secured to the dresser shaft 62, so that the sensor holder 74 vertically moves together with the dresser shaft 62 and the dresser 61. The dresser displacement sensor 72 is secured to the sensor holder 74. The target plate 73 is secured to the dresser oscillation arm 66, so that a height of the target plate 73 is constant. The dresser displacement sensor 72 vertically moves together with the dresser shaft 62, the dresser 61, and the sensor holder 74.

A displacement of the dresser displacement sensor 72 with respect to the target plate 73 is measured by the dresser displacement sensor 72. The dresser displacement sensor 72 can indirectly measure the height of the dresser 61 by measuring the displacement of the dresser displacement sensor 72 with respect to the target plate 73.

The dresser 61, the dresser shaft 62, the air cylinder 64, the dresser displacement sensor 72, the target plate 73, the sensor holder 74, and a thickness calculator (which is constituted of a part of the operation controller 9) constitute a thickness measuring device configured to measure a thickness of the polishing pad 30. In this embodiment, the thickness calculator is constituted of a part of the operation controller 9, while the thickness calculator may be a device provided in addition to the operation controller 9. Furthermore, in one embodiment, the thickness measuring device may include a component other than the above-described components (i.e., the dresser 61, the dresser shaft 62, the air cylinder 64, the dresser displacement sensor 72, the target plate 73, the sensor holder 74, and the thickness calculator).

In one embodiment, the thickness of the polishing pad 30 is measured as follows. First, a height (which will be hereinafter referred to as an initial height) of the dresser 61 is measured in advance when the dresser 61 presses a surface of the polishing table 2 with no polishing pad 30 attached at a predetermined pressing force. The measured value of the initial height is transmitted from the dresser displacement sensor 72 to the thickness calculator (i.e., the operation controller 9). A height (which will be hereinafter referred to as a current height) of the dresser 61 is then measured when the dresser 61 presses the polishing surface 30*a* of the polishing pad 30 placed on the polishing table 2 at a predetermined pressing force. The measured value of the current height is transmitted from the dresser displacement sensor 72 to the thickness calculator. The thickness calculator calculates a thickness of the polishing pad 30 by subtracting the initial height from the current height.

Figure 3:
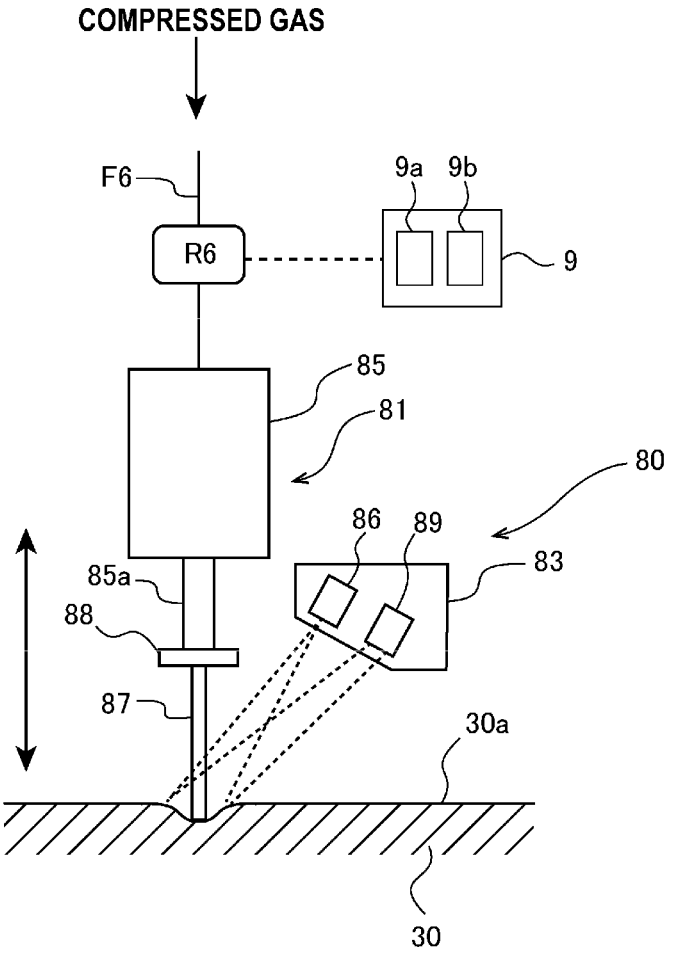
FIG. 3 is a schematic diagram showing an embodiment of a rigidity measuring device.

The polishing apparatus 1 further includes a rigidity measuring device 80 configured to measure a rigidity of the polishing pad 30. FIG. 3 is a schematic diagram showing an embodiment of the rigidity measuring device 80. As shown in FIG. 3, the rigidity measuring device 80 includes a pad pressing mechanism 81 configured to apply a local load to the polishing pad 30, and a profile measuring device 83 configured to measure a size of a deformed region of the polishing pad 30 created by the pad pressing mechanism 81. The pad pressing mechanism 81 includes an air cylinder 85, an elongated rod-shaped pressing rod 87 configured to press the polishing surface 30*a* of the polishing pad 30, and a pressure regulator R6 configured to regulate a pressure of compressed gas in the air cylinder 85.

The air cylinder 85 is coupled to a compressed-gas supply source (not shown) through a gas delivery line F6. The pressure regulator R6 is attached to the gas delivery line F6. Compressed gas, such as compressed air, is supplied to the air cylinder 85 through the gas delivery line F6 via the pressure regulator R6. The pressure regulator R6 is configured to regulate the pressure of the compressed gas in the air cylinder 85. The pressure regulator R6 is coupled to the operation controller 9, and operations of the pressure regulator R6 are controlled by the operation controller 9.

The pressing rod 87 is coupled to a piston rod 85*a* of the air cylinder 85 via a support base 88 fixed to the piston rod 85*a* of the air cylinder 85. The pressing rod 87 extends downward from the support base 88. When the compressed gas is supplied from the compressed-gas supply source into the air cylinder 85, the compressed gas in the air cylinder 85 pushes the piston rod 85*a* downward, and the piston rod 85*a* in turn pushes the pressing rod 87 downward through the support base 88. In this manner, the pressing rod 87 presses against the polishing surface 30*a*. The polishing pad 30 is deformed by being pressed by the pressing rod 87.

A position of the profile measuring device 83 is fixed. The profile measuring device 83 includes a light emitting section 86 configured to direct light to the polishing pad 30, and a light receiving section 89 configured to receive reflected light from the surface of the polishing pad 30 (i.e., the polishing surface 30*a*). The light emitting section 32 includes a laser light source (not shown) configured to emit laser light, and a cylindrical lens (not shown). The light receiving section 89 includes a complementary metal oxide semiconductor (CMOS) element (not shown), and a light receiving lens (not shown).

The profile measuring device 83 measures a size of a region (i.e., a deformed region of the polishing pad 30) deformed by being pressed by the pressing rod 87. A specific measuring method for the size of the deformed region of the polishing pad 30 is as follows. First, the profile measuring device 83 emits the laser light from the laser light source. The laser light is spread in a belt shape by the cylindrical lens, and is diffusely reflected on the polishing surface 30*a*. The profile measuring device 83 measures the size of the deformed region of the polishing pad 30 by receiving the reflected light on the CMOS element and detecting changes in positions and shapes of the deformed region. The profile measuring device 83 is commercially available. An example of the profile measuring device 83 includes LJ-X8000 series manufactured by Keyence Corporation.

The rigidity measuring device 80 indirectly measures the rigidity of the polishing pad 30 by measuring the size of the deformed region of the polishing pad 30 by the profile measuring device 83. The rigidity of the polishing pad 30 is measured as follows. First, the compressed gas is supplied into the air cylinder 85, and the operation controller 9 instructs the pressure regulator R6 to regulate the pressure of the compressed gas in the air cylinder 85 to a predetermined pressure. Therefore, the pressing rod 87 presses the polishing pad 30 at a predetermined pressing force. The profile measuring device 83 directs the laser light to the deformed region of the polishing pad 30, and measures the size of the deformed region of the polishing pad 30. The profile measuring device 83 is coupled to the operation controller 9, and operations of the profile measuring device 83 are controlled by the operation controller 9. Measurement data of the size of the deformed region of the polishing pad 30 measured by the profile measuring device 83 is transmitted to the operation controller 9.

Figure 4:
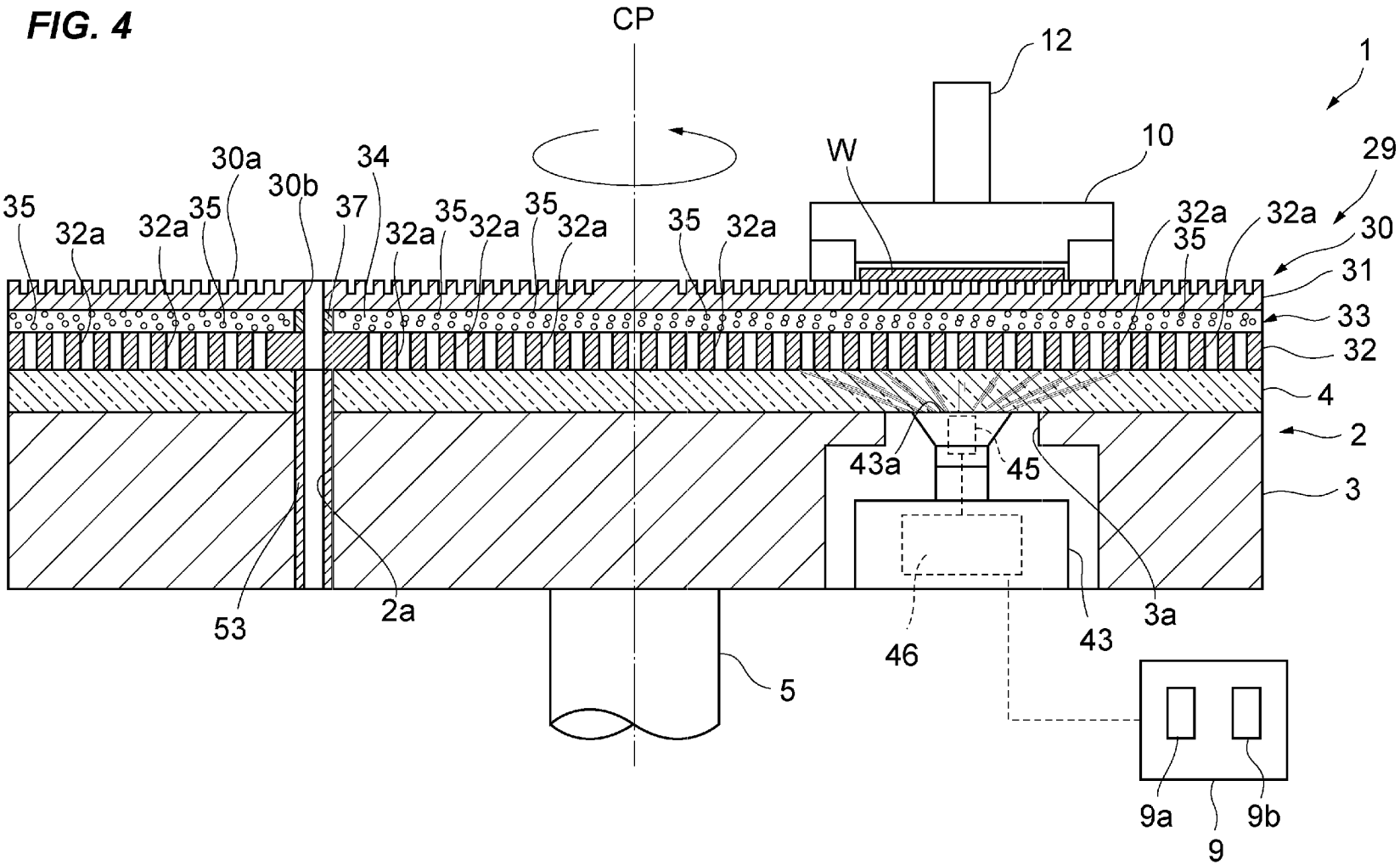
FIG. 4 is a vertical cross-sectional view of the polishing apparatus shown in FIG. 1.
Figure 5:
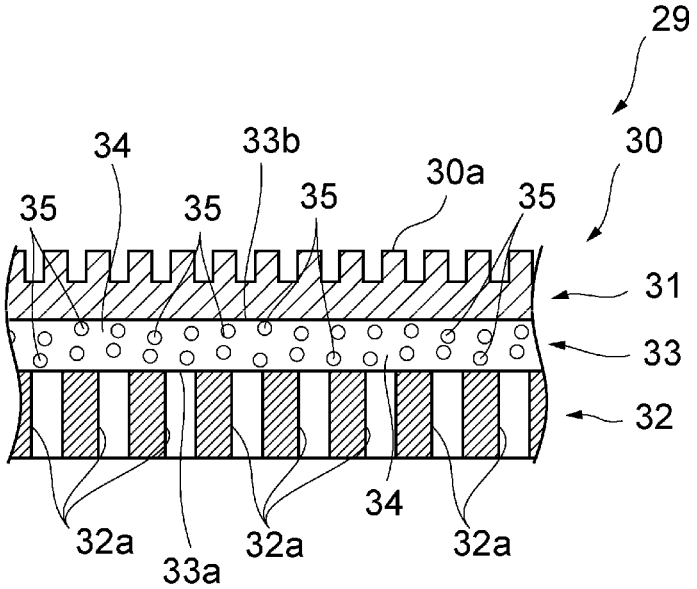
FIG. 5 is an enlarged cross-sectional view of a polishing-pad structure shown in FIG. 4.

FIG. 4 is a vertical cross-sectional view of the polishing apparatus 1 shown in FIG. 1, and FIG. 5 is an enlarged cross-sectional view of the polishing-pad structure 29 shown in FIG. 4. For easier viewing of the diagram, depiction of a part of components is omitted in FIG. 4. As shown in FIGS. 4 and 5, a part of the polishing-pad structure 29 is made of a light transmissive material 34 and a light reactive material 35, the light reactive material 35 being mixed into the light transmissive material 34. In this embodiment, a part of the polishing pad 30 is made of the light transmissive material 34 and the light reactive material 35, the light reactive material 35 being mixed into the light transmissive material 34.

The light transmissive material 34 is a transparent material, and is configured to be able to pass light having a wavelength within a range including at least a range from wavelength of ultraviolet light to wavelength of visible light. Examples of the light transmissive material 34 include resin whose base material is acrylic resin, polyethylene terephthalate, polycarbonate, olefin-based resin, fluororesin, nylon, or polyurethane, and resin whose base material is mixture of two or more of acrylic resin, polyethylene terephthalate, polycarbonate, olefin-based resin, fluororesin, nylon, and polyurethane.

The light reactive material 35 is a substance that changes its state in response to light. Specifically, the light reactive material 35 changes its state between liquid and solid in response to light having a specific wavelength. In this embodiment, the light reactive material 35 is configured to reversibly change its state depending on a wavelength of light directed to the light reactive material 35. Specifically, the light reactive material 35 of this embodiment becomes liquid by being irradiated with ultraviolet light, and becomes solid by being irradiated with visible light. In other words, the light reactive material 35 of this embodiment becomes less rigid by being irradiated with ultraviolet light, and becomes more rigid by being irradiated with visible light. More specifically, the light reactive material 35 of this embodiment becomes more rigid (harder) as the wavelength of the light directed to the light reactive material 35 is longer within the range from wavelength of the ultraviolet light to wavelength of the visible light. Hereinafter, in this specification, such light reactive material 35 may be referred to as a light reversible material.

In one embodiment, a liquid crystalline substance having a sugar alcohol skeleton and a plurality of azobenzene groups is used as the light reversible material. The skeleton is not limited to this embodiment as long as the skeleton can be utilized for the light reversible property. Such light reversible material may be azo-based compound, stilbene-based compound, azomethine-based compound, or the like, which is photoisomerizable compound that causes trans-cis photoisomerization.

The polishing pad 30 has a multilayered structure. The polishing pad 30 includes a polishing layer 31 having the polishing surface 30*a*, a light reactive layer 33 coupled to an opposite side of the polishing layer 31 from the polishing surface 30*a*, and a cushion layer 32 coupled to the light reactive layer 33. The cushion layer 32, the light reactive layer 33, and the polishing layer 31 are layered in this order. The light reactive layer 33 has a first light-transmissive surface 33*a* facing away from the polishing surface 30*a*, and a second light-transmissive surface 33*b* located at the opposite side from the first light-transmissive surface 33*a*. The cushion layer 32 is coupled to the first light-transmissive surface 33*a*. The polishing-pad structure 29 is placed on the polishing table 2 with the cushion layer 32 of the polishing pad 30 facing downward.

The polishing layer 31 is made of a hard material having a high rigidity, and the cushion layer 32 has a cushioning property. Specifically, the polishing layer 31 and the cushion layer 32 have elasticity, and the cushion layer 32 is made of a material having lager compressibility than that of the polishing layer 31. An example of the polishing layer 31 includes IC1000 manufactured by Nitta Haas Incorporated, and an example of the cushion layer 32 includes SUBA400 manufactured by Nitta Haas Incorporated.

The light reactive layer 33 is configured to change its physical property in response to light. The light reactive layer 33 has the light transmissive material 34 and the light reactive material 35. At least a part of the light reactive layer 33 is made of the light transmissive material 34 and the light reactive material 35, the light reactive material 35 being mixed into the light transmissive material 34.

As described above, the light reactive material 35 of this embodiment becomes more rigid (harder) as the wavelength of the light directed to the light reactive material 35 becomes longer within the range from the wavelength of ultraviolet light to the wavelength of visible light. Therefore, at least a part of the light reactive layer 33, i.e., at least a region of the light reactive layer 33 in which the light reactive material 35 has been mixed is more rigid (harder) as the wavelength of the light directed to the light reactive material 35 becomes longer within the range from the wavelength of ultraviolet light to the wavelength of visible light. Thus, the light reactive layer 33 of this embodiment changes its physical property (i.e., rigidity) depending on the wavelength of the light applied to the light reactive layer 33.

As shown in FIG. 4, the polishing apparatus 1 further includes a plurality of light sources 43 configured to emit light to the polishing-pad structure 29. In FIG. 4, only one light source 43 is depicted. The light source 43 is disposed in the polishing table 2. The polishing table 2 includes a table body 3 coupled to the table shaft 5, and a transparent support plate 4 configured to support the polishing-pad structure 29. The support plate 4 is arranged on a surface (i.e., an upper surface) of the table body 3. A surface of the support plate 4 constitutes the surface of the polishing table 2.

Each light source 43 includes a light emitting section 45 including a light emitting element configured to emit light, and a driver 46 configured to drive the light emitting section 45. In this embodiment, each light source 43 is configured to be able to change a wavelength of the light. Specifically, each light source 43 is configured to be able to change a wavelength of the light within a range at least from a wavelength of the ultraviolet light to a wavelength of the visible light. In one embodiment, such a light source 43 may be a variable wavelength light source which is commercially available. Each light source 43 is arranged in the table body 3 such that an emitting port 43*a* faces upward (i.e., faces toward the polishing-pad structure 29). A plurality of openings 3*a* are formed in the table body 3, and the light (ultraviolet light or visible light) emitted from each light source 43 is directed to the support plate 4 through each opening 3*a*. In FIG. 4, only one opening 3*a* is depicted.

In this embodiment, the support plate 4 is made of transparent ceramic. In one embodiment, the support plate 4 may be made of quartz glass. The light emitted from each light source 43 passes through the support plate 4, and is directed to the cushion layer 32 of the polishing pad 30. A plurality of through-holes 32*a* extending in a thickness direction of the cushion layer 32 are formed in the cushion layer 32. The light passed through the support plate 4 is directed to the light reactive layer 33 through the through-holes 32*a*. The light directed to the light reactive layer 33 passes through the light transmissive material 34, and is directed to the light reactive material 35. As a result, the light reactive layer 33 changes its physical property in response to the light.

In one embodiment, the cushion layer 32 may be made of a material that allows light to pass therethrough. In this case, the cushion layer 32 may not have the through-holes 32*a*. Examples of the material of the cushion layer 32 that allows light to pass include polyurethane elastomer, polystyrene elastomer, polyester elastomer, polyamide elastomer, polyolefin elastomer, soft vinyl chloride, and silicone rubber.

A plurality of holes 2*a* are formed in the polishing table 2, and a plurality of through-holes 30*b* are formed in the polishing pad 30. When the polishing apparatus 1 is viewed from above, positions of the holes 2*a* and the through-holes 30*b* are coincident. In FIG. 4, only one hole 2*a* and one through-hole 30*b* are depicted. The holes 2*a* and the through-holes 30*b* are holes through which light emitted from an optical film-thickness measuring device (not shown) passes. The optical film-thickness measuring device is configured to measure a film thickness of the substrate W. The optical film-thickness measuring device directs light to the surface of the substrate W, and determines the film thickness of the substrate W based on light-intensity measurement data of reflected light from the substrate W. In one embodiment, only one hole 2*a* and only one through-hole 30*b* may be provided. In FIG. 4, the hole 2*a* is depicted as a through-hole, while the hole 2*a* may not be through-hole as long as the hole 2*a* is open in the surface of the polishing table 2.

An inner circumferential surface of each hole 2*a* is covered with a shield layer 53 containing a light impermeable material that reflects or absorbs the light emitted from the optical film-thickness measuring device. Therefore, interference between the light emitted from the optical film-thickness measuring device and the light emitted from the light source 43 can be prevented. The light reactive layer 33 further has a light impermeable material 37, and each through-hole 30*b* of the light reactive layer 33 is surrounded by the light impermeable material 37. With this arrangement, the light impermeable material 37 can prevent the light reactive material 35 from being irradiated with the light of the optical film-thickness measuring device. Examples of the light impermeable material of the shield layer 53 and the light impermeable material 37 include polycarbonate resin having a high light reflectance, light reflective polypropylene, and polyurethane mixed with carbon black having a good light absorption.

When the film thickness of the substrate W is not measured with the optical film-thickness measuring device, the polishing table 2 may not have the holes 2*a* and the shield layer 53, the polishing pad 30 may not have the through-holes 30*b*, and the light reactive layer 33 may not have the light impermeable material 37. When the light reactive layer 33 does not have the light impermeable material 37, the entire light reactive layer 33 may be constituted of the light transmissive material 34 and the light reactive material 35, the light reactive material 35 being mixed into the light transmissive material 34.

Figure 6:
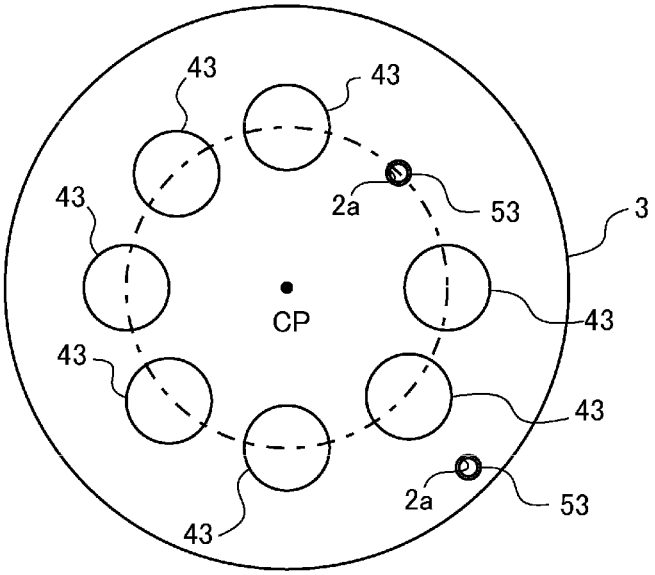
FIG. 6 is a top view of a table body.
Figure 7:
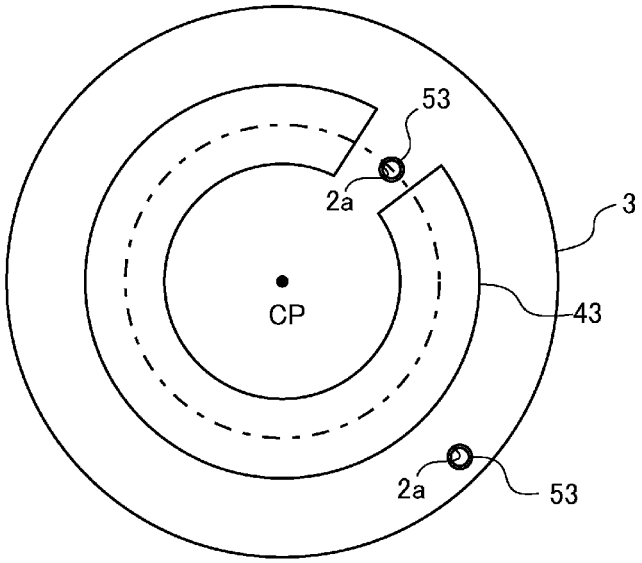
FIG. 7 is a schematic diagram showing another embodiment of a light source.

FIG. 6 is a top view of the table body 3. The plurality of light sources 43 are arranged so as to be able to direct the light to the entire portion of the light reactive layer 33 whose physical property is to be changed (e.g., a portion deformed due to the load of the retainer ring 20), while the plurality of light sources 43 are arranged so as to avoid the holes 2*a*. Specifically, the plurality of light sources 43 are arranged so as to surround the axis CP of the table shaft 5, and are located away from each other in a circumferential direction. The light sources 43 are arranged below a position through which the polishing head 10 passes during polishing. In one embodiment, the light sources 43 may be configured to be able to direct the light to the entire light reactive layer 33. In one embodiment, as shown in FIG. 7, only a single light source 43 may be provided. In this embodiment, the light source 43 has a partially-cut annular shape (C shape). As a result, the light emitted by the single light source 43 can be directed to the entire portion of the light reactive layer 33 whose physical property is to be changed while the light avoids the holes 2*a*. In one embodiment, only the emitting port 43*a* and the light emitting section 45 may have a partially-cut annular shape.

The light directed to the support plate 4 is refracted. Therefore, an irradiation range of the light directed to the polishing-pad structure 29 can be widened by passing the light through the support plate 4. In one embodiment, when the light sources 43 can sufficiently direct the light to the portion of the light reactive layer 33 whose physical property is to be changed, the light sources 43 may directly emit the light to the polishing-pad structure 29 without passing the light through the support plate 4.

In this embodiment, a part of a conventional polishing pad can be used as the polishing layer 31. Furthermore, according to this embodiment, the arrangement of the light sources 43 in the polishing table 2 can reduce a possibility of exposure of components other than the support plate 4 and the polishing-pad structure 29 to the ultraviolet light. As a result, deterioration due to the ultraviolet light can be suppressed.

In one embodiment, in order to prevent deterioration due to the ultraviolet light emitted from the light sources 43, a part of the polishing apparatus 1 (e.g., a portion other than the support plate 4 and the polishing-pad structure 29 which is affected by the light emitted from the light sources 43) may be covered with a coating layer that blocks or absorbs the ultraviolet light. The coating layer is attached to the part of the polishing apparatus 1 by a method, such as painting, plating, or film attachment. In one embodiment, such coating layer contains an ultraviolet blocking agent. Examples of the ultraviolet blocking agent include carbon black, and inorganic pigment. Furthermore, in one embodiment, the coating layer may contain an ultraviolet absorbent that converts ultraviolet light into heat energy.

Furthermore, in one embodiment, the part of the polishing apparatus 1 (e.g., the portion other than the support plate 4 and the polishing-pad structure 29 which is affected by the light emitted from the light sources 43) may be made of plastic material that hardly absorbs ultraviolet light. Examples of the plastic material that hardly absorbs ultraviolet light include PMMA (polymethyl methacrylate), polycarbonate, polyvinyl chloride, and polytetrafluoroethylene.

In this embodiment, a change in the polishing profile caused by a change in the thickness of the polishing pad 30 can be suppressed by changing the physical property (e.g., rigidity) of a part of the polishing-pad structure 29 (a part constituted of the light transmissive material 34 and the light reactive material 35, and in this embodiment, the light reactive layer 33) according to the thickness or the rigidity of the polishing pad 30. In other words, reduction in rigidity due to the decrease in thickness of the polishing pad 30 can be compensated by increasing the rigidity of the portion constituted of the light transmissive material 34 and the light reactive material 35. Therefore, the polishing pad 30 can compensate for the change in its rigidity caused by the change in the thickness of the polishing pad 30. In this specification, a term of polishing profile means a rate of change in the polishing rate associated with a change in the pressure of the retainer ring 20, i.e., a profile of an amount of change in the polishing rate of the substrate W per unit pressure of the retainer ring 20.

Figure 8A:
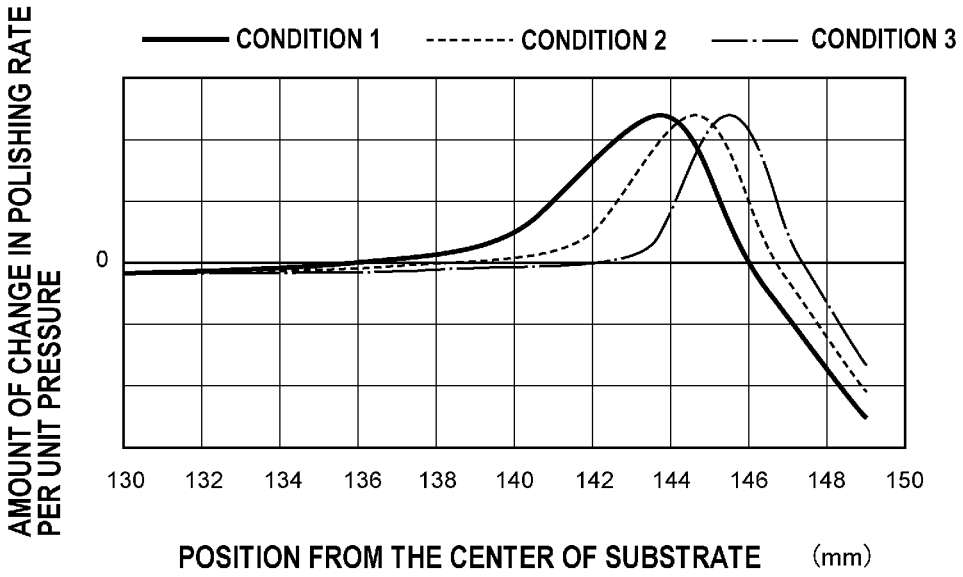
FIG. 8A is a graph showing polishing profiles when a conventional polishing pad constituted of an upper-layer pad and a lower-layer pad is used.
Figure 8B:
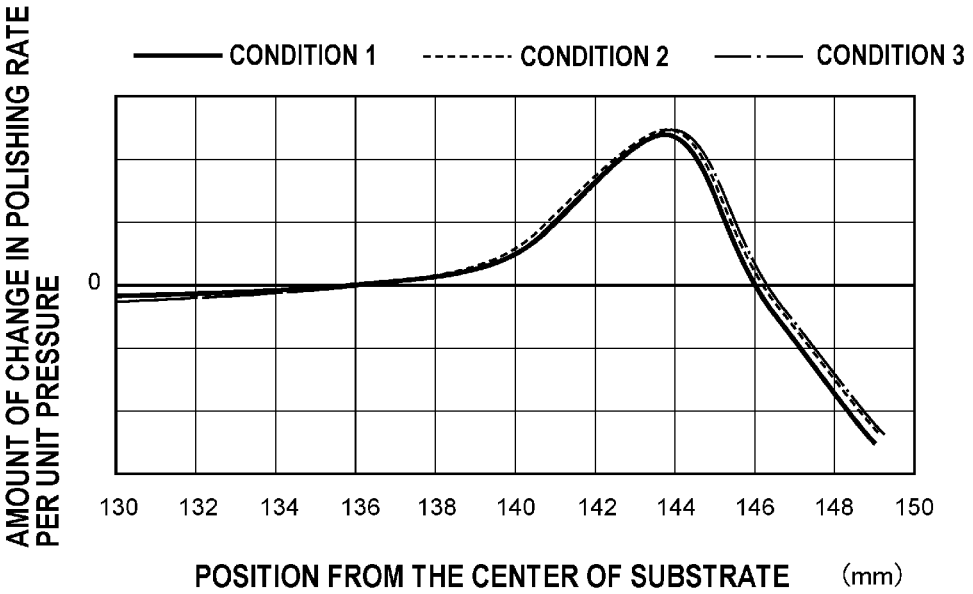
FIG. 8B is a graph showing polishing profiles when a polishing pad of the embodiment is used.

FIG. 8A is a graph showing polishing profiles when a conventional polishing pad constituted of an upper-layer pad and a lower-layer pad is used, and FIG. 8B is a graph showing polishing profiles when the polishing pad 30 of this embodiment is used. Vertical axis in each of FIGS. 8A and 8B indicates an amount of change in polishing rate per unit pressure of the retainer ring, and horizontal axis in each of FIGS. 8A and 8B indicates a position from a center of a substrate. The amount of change in polishing rate per unit pressure of 0 means that the polishing rate does not change when the pressure of the retainer ring is changed. Conditions 1, 2, and 3 in FIGS. 8A and 8B indicate use frequency of the polishing pad. The use frequency of the polishing pad in the condition 2 is greater than that in the condition 1 (i.e., a use time of the polishing pad in the condition 2 is longer than that in the condition 1). The use frequency of the polishing pad in the condition 3 is greater than that in the condition 2 (i.e., a use time of the polishing pad in the condition 3 is longer than that in the condition 2). FIG. 8B shows a graph when the rigidity of the light reactive layer 33 is changed according to the use frequency of the polishing pad 30 (i.e., the thickness of the polishing pad). Specifically, FIG. 8B shows a result when the rigidity of the light reactive layer 33 is increased according to the increase in the wavelength of the light directed to the polishing pad 30 as the polishing pad 30 becomes thinner.

As shown in FIG. 8A, in the conventional polishing pad, a peak of the polishing profile shifts outwardly in the substrate as the use frequency of the polishing pad is increasing (i.e., as the thickness of the polishing pad decreases). In other words, a region where the polishing rate can be changed by changing the pressure of the retainer ring (which will be hereinafter referred to as a responsive region) has been shifted to an edge side of the substrate. Furthermore, the amount of change in the polishing rate at the edge portion of the substrate has been changed. This means that changing the pressure of the retainer ring does not allow the polishing rate at a desired position to be changed accurately. In contrast, as shown in FIG. 8B, in this embodiment, the change in the polishing profile due to the thickness of the polishing pad 30 can be suppressed by changing the rigidity of the light reactive layer 33 according to the thickness of the polishing pad 30. As a result, the polishing rate at the desired position in the periphery of the substrate W can be accurately controlled by regulating the pressure of the retainer ring 20.

Figure 9A:
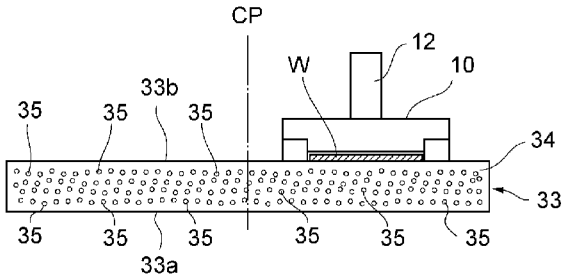
FIG. 9A is a diagram illustrating a light reactive material distributed in an entire light reactive layer.
Figure 9B:
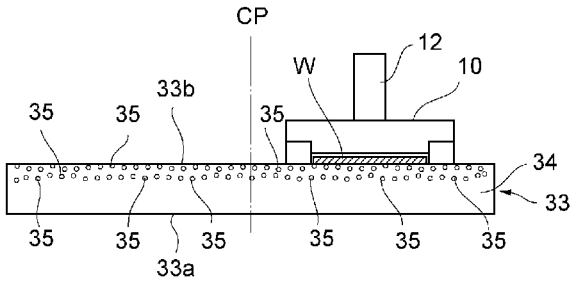
FIG. 9B is a diagram illustrating the light reactive material distributed in a biased manner toward a second light-transmissive surface.
Figure 9C:
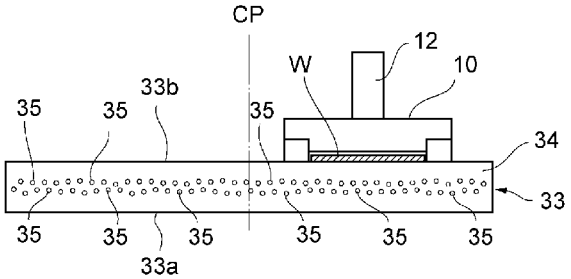
FIG. 9C is a diagram illustrating the light reactive material distributed in a central region of the light reactive layer in a thickness direction of the light reactive layer.
Figure 9D:
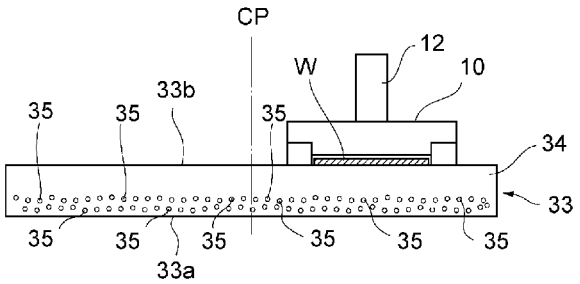
FIG. 9D is a diagram illustrating the light reactive material distributed in a biased manner toward a first light-transmissive surface.
Figure 9E:
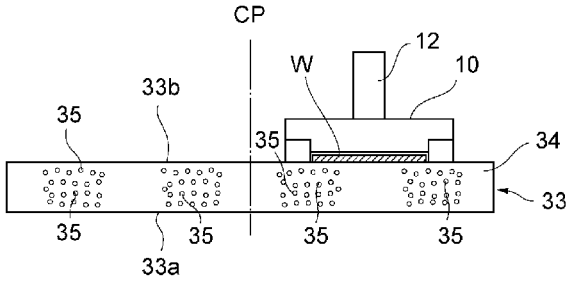
FIG. 9E is a diagram illustrating the light reactive material distributed only in regions located below a periphery of a substrate W during polishing of the substrate W.
Figure 9F:
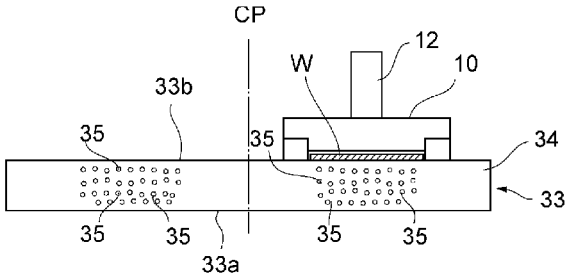
FIG. 9F is a diagram illustrating the light reactive material distributed only in a region located below a central portion of a substrate W during polishing of the substrate W.

In one embodiment, the light reactive material 35 may be distributed such that the light reactive material 35 is located in a desired region. FIG. 9A is a diagram illustrating the light reactive material 35 distributed in the entire light reactive layer 33, FIG. 9B is a diagram illustrating the light reactive material 35 distributed in a biased manner toward the second light-transmissive surface 33*b*, FIG. 9C is a diagram illustrating the light reactive material 35 distributed in a central region of the light reactive layer 33 in a thickness direction of the light reactive layer 33, FIG. 9D is a diagram illustrating the light reactive material 35 distributed in a biased manner toward the first light-transmissive surface 33*a*, FIG. 9E is a diagram illustrating the light reactive material 35 distributed in regions located below the periphery of the substrate W during polishing of the substrate W, and FIG. 9F is a diagram illustrating the light reactive material 35 distributed in a region located below the central portion of the substrate W during polishing of the substrate W. In FIGS. 9A to 9F, for the purpose of descriptions, depiction of the polishing layer 31 is omitted.

As shown in FIGS. 9E and 9F, the distribution of the light reactive material 35 only in the region(s) that affects the polishing profile of the substrate W can minimize an amount of use of the light reactive material 35 to thereby contribute to cost reduction.

Figure 10A:
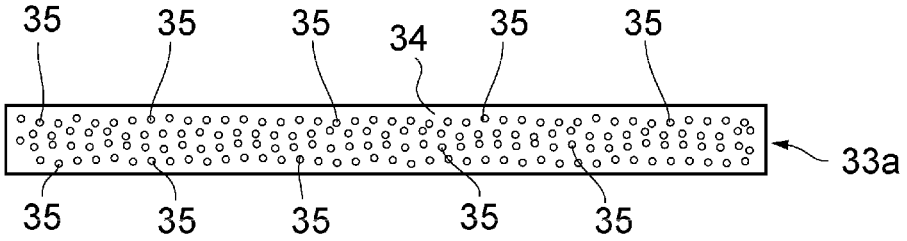
FIG. 10A is a diagram showing an example of a method of manufacturing the light reactive layer with controlling the distribution of the light reactive material.
Figure 10B:
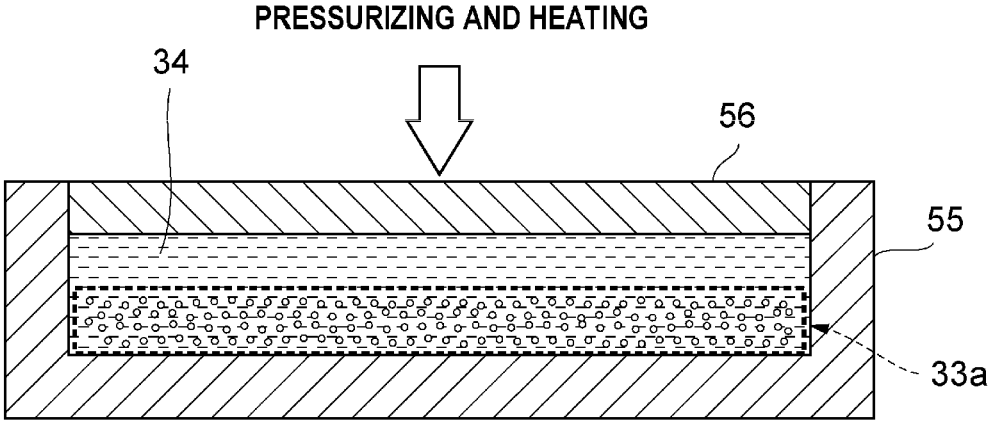
FIG. 10B is a diagram showing an example of the method of manufacturing the light reactive layer with controlling the distribution of the light reactive material.

FIGS. 10A and 10B are diagrams showing an example of a method of manufacturing the light reactive layer 33 with controlling the distribution of the light reactive material 35. First, a pad piece 33*a* in which the light reactive material 35 is distributed in the entire light transmissive material 34 is manufactured (FIG. 10A). Next, the pad piece 33*a* is put into a mold 55 together with the light transmissive material 34 in a liquid state or in a clay state (FIG. 10B). At this time, a position of the pad piece 33*a* in a depth direction of the mold 55 is adjusted. An opening of the mold 55 is then closed with a lid 56. The light transmissive material 34 in a liquid state or in a clay state and the pad piece 33*a* are pressurized and heated to be cured through the lid 56. In this way, the distribution of the light reactive material 35 in the thickness direction of the light reactive layer 33 can be controlled.

When controlling the distribution of the light reactive material 35 in a radial direction of the light reactive layer 33, a ring-shaped pad piece 33*a* is manufactured. The ring-shaped pad piece 33*a* is then put into a mold 55 together with the light transmissive material 34 in a liquid state or in a clay state, and the light reactive layer 33 is manufactured by the same method as the method described with reference to FIG. 10B.

In one embodiment, the light reactive layer 33 may be manufactured by a 3D printer. In this embodiment, the 3D printer utilizes a CAD (computer aided design) program to manufacture the light reactive layer 33. Such 3D printer includes a first nozzle configured to emit droplets of the light transmissive material 34, and a second nozzle configured to emit droplets of the light reactive material 35. The droplets of the light transmissive material 34 and the droplets of the light reactive material 35 are supplied to selected locations or regions. These selected regions are determined based on a CAD data file. A controller controls operations of the first nozzle and the second nozzle based on the CAD data file to form the light reactive layer 33.

The controller of the 3D printer includes a memory storing programs therein, and a processor configured to perform arithmetic operations according to instructions contained in the programs. The processor includes a CPU (central processing unit) or GPU (graphic processing unit) configured to perform arithmetic operations according to the instructions contained in the programs stored in the memory. The programs contain codes for monitoring, performing, controlling, etc., for amounts of supply of the droplets, movements of the first and second nozzles, positioning of the first and second nozzles. The memory includes a main memory (e.g., a random access memory) accessible by the processor, and an auxiliary memory (e.g., a hard disk drive or a solid state drive) storing data and the programs. The above-described CAD data file is stored in the memory. The controller is composed of at least one computer.

The controller controls the first and second nozzles to stack the light transmissive material 34 and the light reactive material 35 while changing a mixing proportion of the light reactive material 35 in the light transmissive material 34 in a height direction, so that the distribution of the light reactive material 35 in the thickness direction of the light reactive layer 33 is controlled. In one embodiment, the 3D printer gradually molds the light reactive layer 33 while changing the mixing proportion of the light reactive material 35 in the light transmissive material 34 in the radial direction, so that the distribution of the light reactive material 35 in the radial direction of the light reactive layer 33 is controlled.

After 3D printing, the light reactive layer 33 may be cured by a curing device or the like. The curing device cures the light reactive layer 33 by heating the light reactive layer 33. In one embodiment, the curing device cures the light reactive layer 33 by exposing the light reactive layer 33 to electromagnetic radiation or an electron beam.

Figure 11:
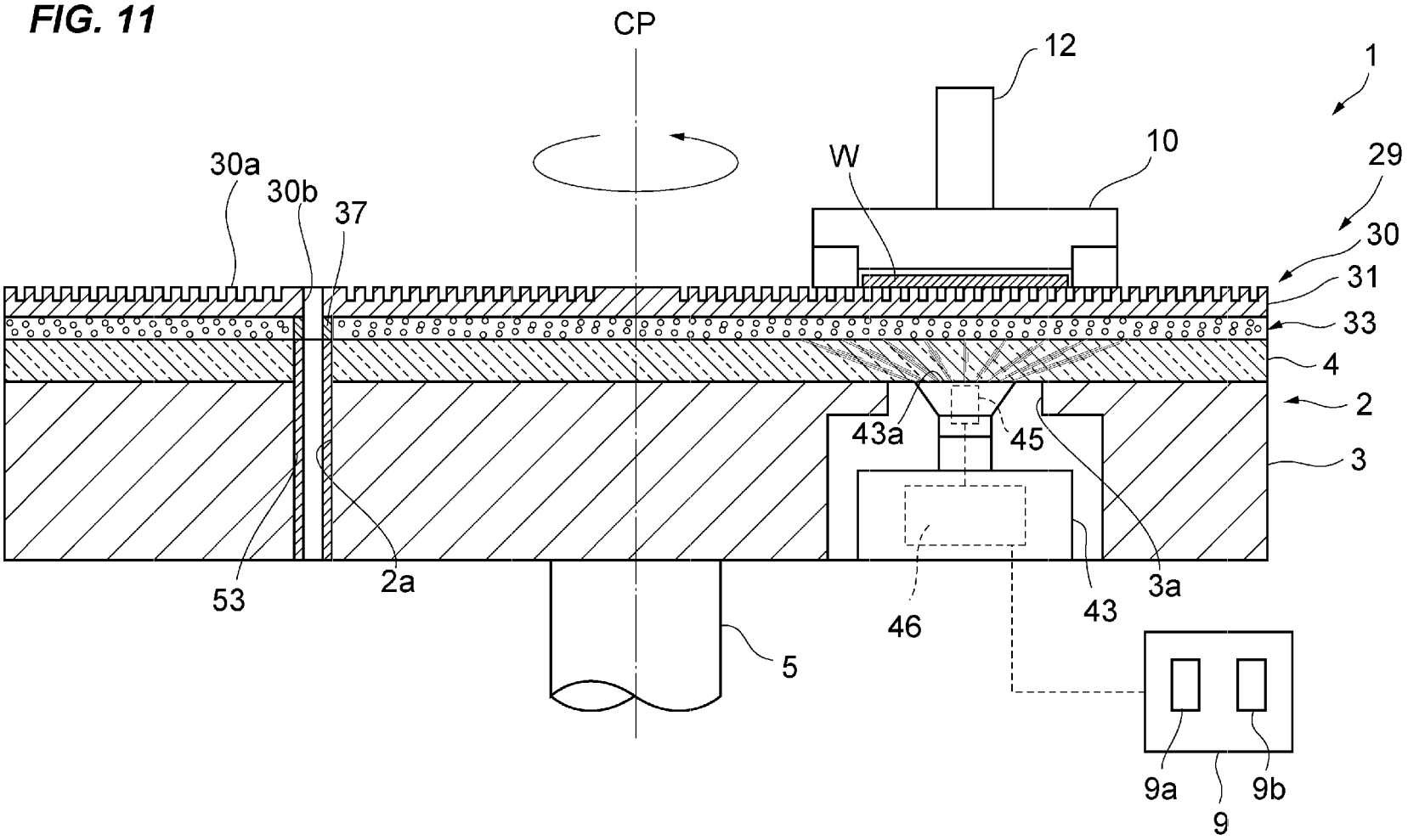
FIG. 11 is a schematic diagram showing another embodiment of the polishing apparatus.

FIG. 11 is a schematic diagram showing another embodiment of the polishing apparatus 1. Details of this embodiment, which will not be particularly described, are the same as those of the embodiments described with reference to FIGS. 1 to 10, and duplicated descriptions will be omitted. The polishing pad 30 of this embodiment differs from the polishing pad 30 described with reference to FIGS. 1 to 10 in that it does not have the cushion layer 32. In this embodiment, the polishing-pad structure 29 is placed on the surface of the polishing table 2 (i.e., the surface of the support plate 4) with the light reactive layer 33 of the polishing pad 30 facing downward. The light reactive layer 33 may be irradiated with ultraviolet light having a predetermined wavelength in advance to reduce the rigidity of the light reactive layer 33, so that the light reactive layer 33 can serve as the cushion layer 32.

Figure 12:
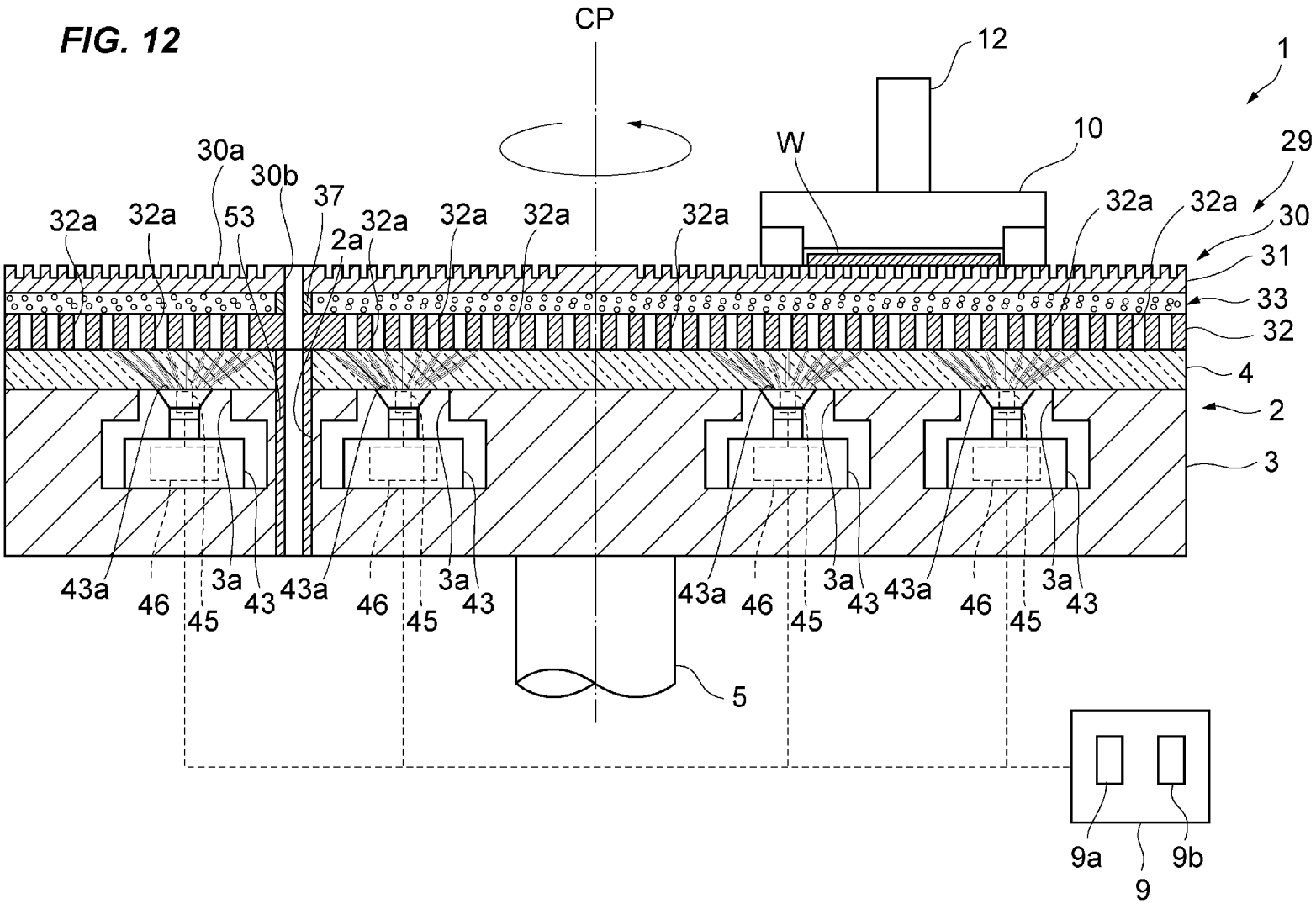
FIG. 12 is a schematic diagram showing still another embodiment of the polishing apparatus.
Figure 13:
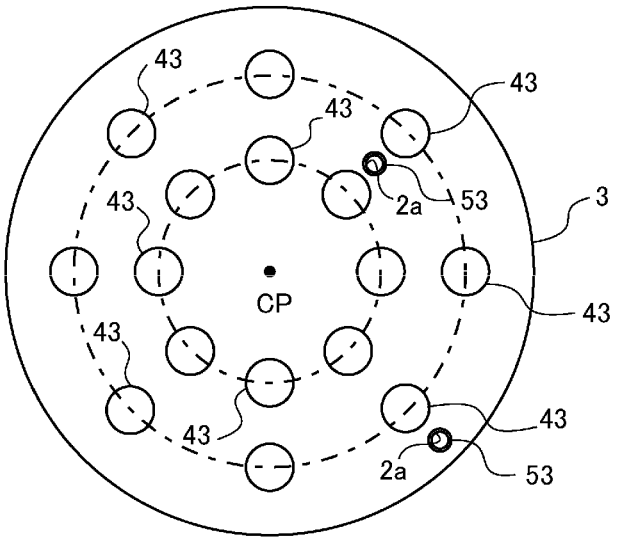
FIG. 13 is a top view of a table body shown in FIG. 12.

FIG. 12 is a schematic diagram showing still another embodiment of the polishing apparatus 1, and FIG. 13 is a top view of the table body 3 shown in FIG. 12. Details of this embodiment, which will not be particularly described, are the same as those of the embodiments described with reference to FIGS. 1 to 10, and duplicated descriptions will be omitted. A size of each light source 43 in this embodiment is smaller than the size of each light source 43 described with reference to FIGS. 1 to 10. The number of light sources 43 in this embodiment is larger than that of the light sources 43 described with reference to FIGS. 1 to 10. In this embodiment, the plurality of light sources 43 are arranged so as to be able to direct the light to the entire portion of the light reactive layer 33 whose physical property is to be changed, while the plurality of light sources 43 are arranged so as to avoid the holes 2*a*. Specifically, the plurality of light sources 43 are arranged so as to surround the axis CP of the table shaft 5, and are located away from each other in the circumferential direction. In this embodiment, two combinations of light sources 43, which are located away from each other in a radial direction, are provided. The light sources 43 of each combination are located away from each other in the circumferential direction. In one embodiment, the light sources 43 may be configured to be able to direct the entire light reactive layer 33.

Figure 14:
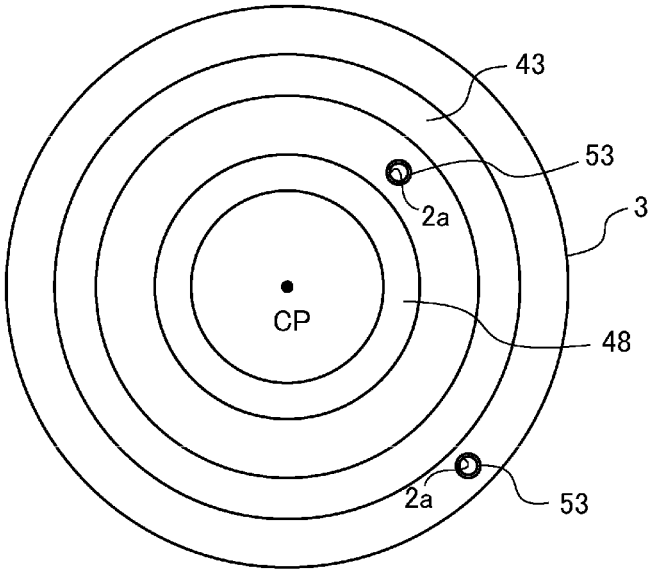
FIG. 14 is a schematic diagram showing another embodiment of the polishing apparatus.

In one embodiment, as shown in FIG. 14, the polishing apparatus 1 may include one light source 43, and one light source 48. In this embodiment, each of the light sources 43 and 48 has an annular shape. Each of the light sources 43 and 48 is arranged so as to avoid the holes 2*a*, and the diameter of the light source 43 and the diameter of the light source 48 are different when viewed from above. Configurations of the light source 48 other than the diameter are the same as those of the light source 43. In this embodiment, the light sources 43 and 48 can also direct the light to the entire portion of the light reactive layer 33 whose physical property is to be changed, while the light sources 43 and 48 are arranged so as to avoid the holes 2*a*. In one embodiment, only the emitting port 43*a* and the light emitting section 45 of the light source 43 may have an annular shape, and only an emitting port (not shown) and a light emitting section (not shown) of the light source 48 may have an annular shape. The configurations of the embodiment described with reference to FIG. 11 can also be applied to this embodiment.

Figure 15:
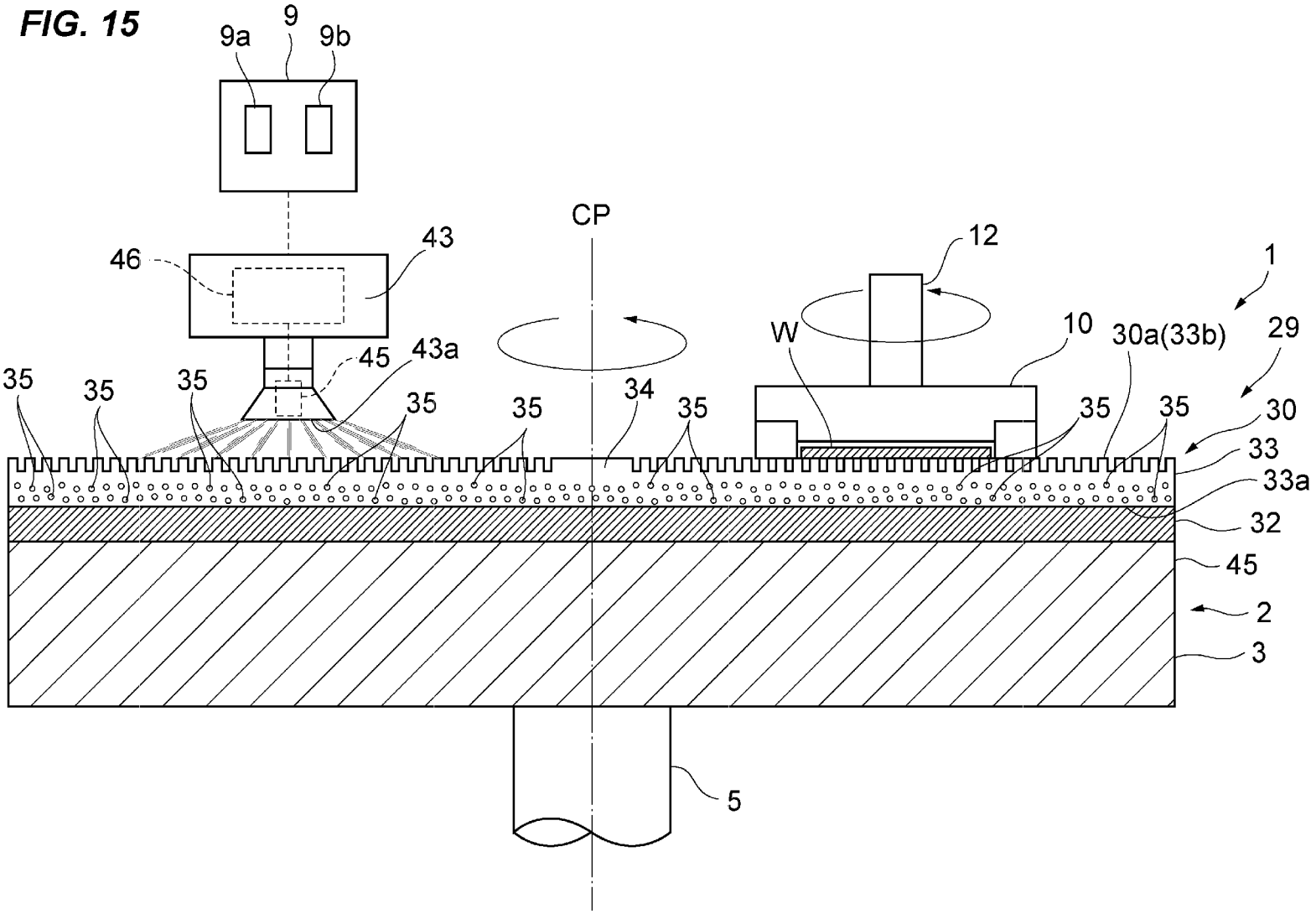
FIG. 15 is a schematic diagram showing still another embodiment of the polishing apparatus.

FIG. 15 is a schematic diagram showing still another embodiment of the polishing apparatus 1. Details of this embodiment, which will not be particularly described, are the same as those of the embodiments described with reference to FIGS. 1 to 10, and duplicated descriptions will be omitted. The polishing pad 30 of this embodiment does not include the polishing layer 31, and the cushion layer 32 of this embodiment does not have the through-holes 32*a*. In this embodiment, the light reactive layer 33 has a polishing surface 30*a*. Specifically, the second light-transmissive surface 33*b* constitutes the polishing surface 30*a*, and the light reactive layer 33 functions as the polishing layer.

The light source 43 of this embodiment is disposed above the polishing table 2, and is arranged so as to face the polishing surface 30*a* of the polishing pad 30. The light emitted from the light source 43 is directly incident on the light reactive layer 33 from above the polishing surface 30*a* (i.e., from the polishing-surface-30*a* side). The single light source 43 is provided in this embodiment, and a position of the light source 43 is fixed. The light can be directed to the entire portion of the light reactive layer 33 whose physical property is to be changed (e.g., a portion that can be deformed due to the load of the retainer ring 20) by directing the light (i.e., ultraviolet light or visible light) to the light reactive layer 33 while rotating the polishing pad 30 together with the polishing table 2. In one embodiment, the polishing apparatus 1 may include a plurality of light sources 43. Furthermore, in one embodiment, the light source 43 may be configured to be able to direct the light to the entire light reactive layer 33.

In this embodiment, since the light is directed to the polishing pad 30 from the polishing-surface-30*a* side, it is not necessary to provide the through-holes 32*a* in the cushion layer 32. In one embodiment, as shown in FIGS. 9C and 9D, the light reactive material 35 may be distributed in the central region of the light reactive layer 33 in a thickness direction of the light reactive layer 33 or may be biased toward the first light-transmissive surface 33*a*. Distributing the light reactive material 35 in this manner can prevent the light reactive material 35 from being exposed on the polishing surface 30*a* due to wear of the light reactive layer 33 with polishing or dressing. Although not shown in FIG. 15, in this embodiment, the polishing table 2 may also have the holes 2*a* and the shield layer 53, and the polishing pad 30 may also have the through-holes 30*b* and the light impermeable material 37.

In this embodiment, the polishing table 2 does not include the support plate 4, and the surface of the table body 3 constitutes the surface of the polishing table 2. This configuration with no support plate 4 can prevent a decrease in cooling efficiency due to a difference in the material between the table body 3 and the support plate 4. In one embodiment, as with the embodiments described with reference to FIGS. 1 to 10, the polishing table 2 may include the support plate 4.

Figure 16:
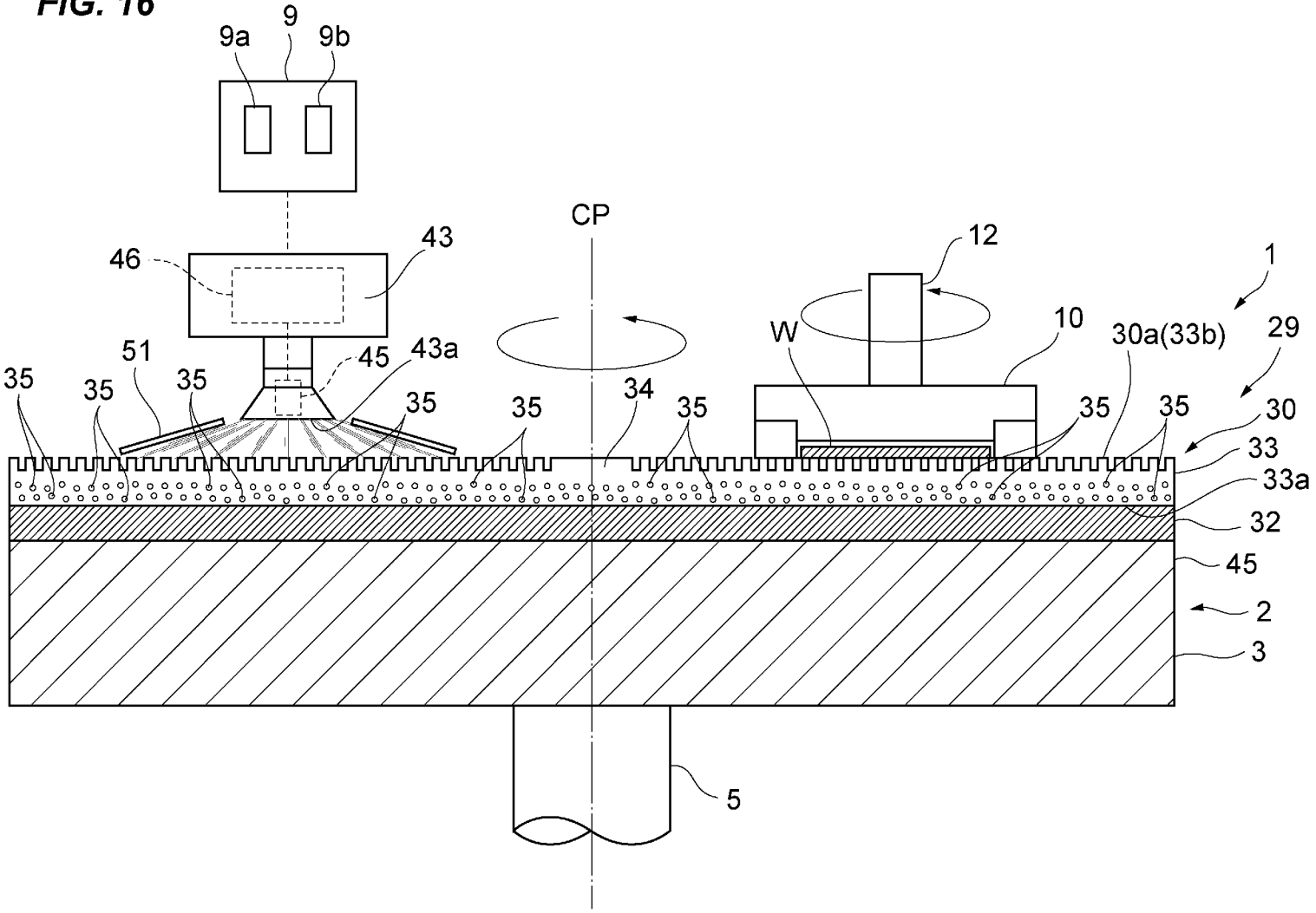
FIG. 16 is a schematic diagram showing still another embodiment of the polishing apparatus.

In one embodiment, as shown in FIG. 16, the polishing apparatus 1 may include a light shielding cover 51 configured to cover the entire light emitted from the light source 43. The light shielding cover 51 can prevent components other than the polishing-pad structure 29 from being irradiated with the ultraviolet light emitted from the light source 43.

Further, in one embodiment, the polishing pad 30 may be constituted of only the light reactive layer 33. The distribution and the rigidity of the light reactive material 35 may be adjusted so that the light reactive layer 33 can function as both the polishing layer and the cushion layer. Furthermore, in one embodiment, a space in which the polishing apparatus 1 is installed may be a dark room such that the polishing-pad structure 29 is not exposed to any light other than the light from the light sources 43. A side surface of the light reactive layer 33 may be covered with the light impermeable material 37.

Figure 17:
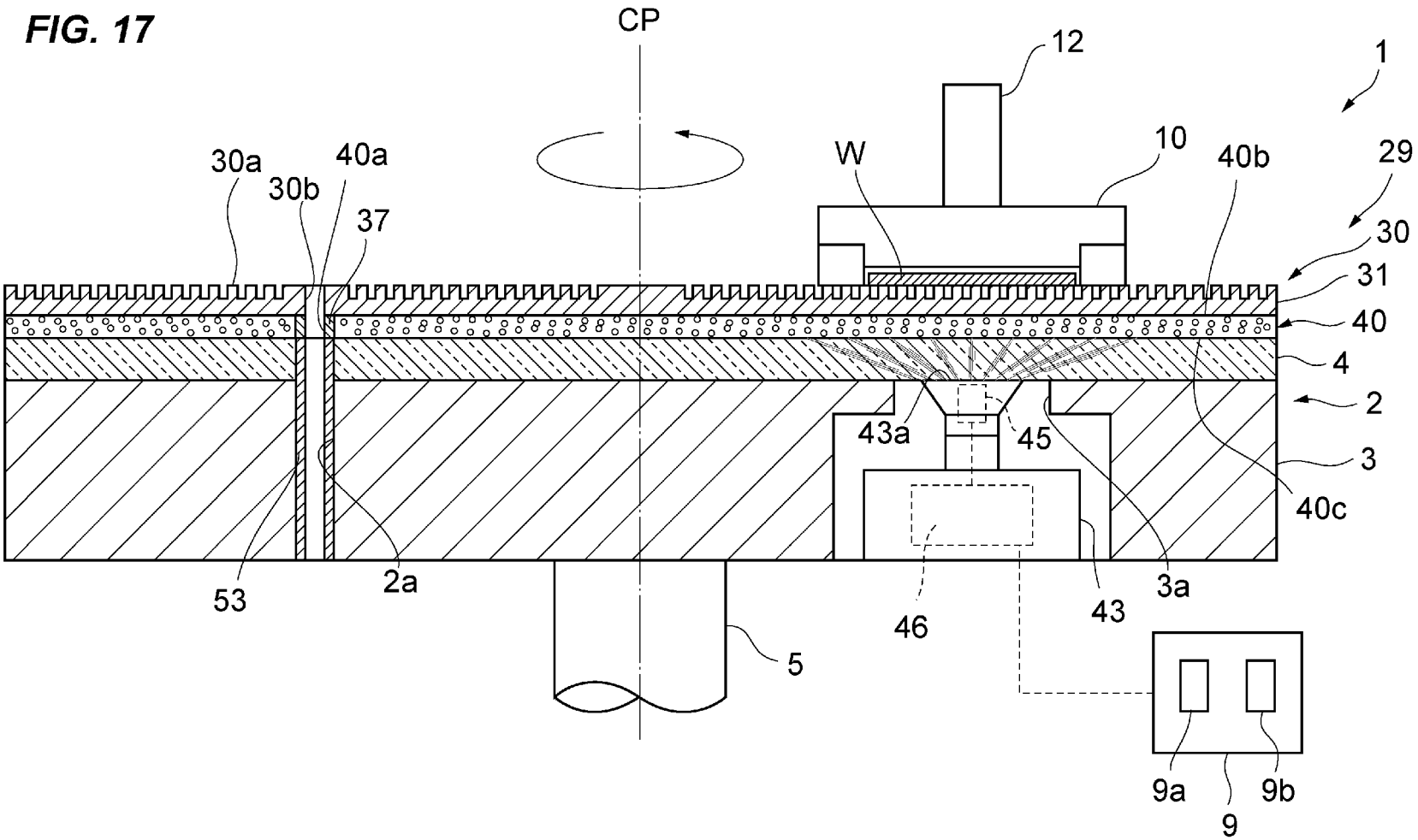
FIG. 17 is a schematic diagram showing still another embodiment of the polishing apparatus.

FIG. 17 is a schematic diagram showing still another embodiment of the polishing apparatus 1. Details of this embodiment, which will not be particularly described, are the same as those of the embodiments described with reference to FIGS. 1 to 10, and duplicated descriptions will be omitted. The polishing pad 30 of this embodiment differs from the polishing pad 30 described with reference to FIGS. 1 to 10 in that it does not have the light reactive layer 33 and the cushion layer 32. In this embodiment, the polishing-pad structure 29 includes a polishing pad 30, and a light reactive sheet 40 configured to change its physical property in response to light. In this embodiment, the light reactive sheet 40 is placed on the surface of the polishing table 2 (specifically, the surface of the support plate 4), and the polishing pad 30 is placed on the light reactive sheet 40. The light emitted from the light sources 43 passes through the support plate 4 to reach the light reactive sheet 40.

The light reactive sheet 40 has a light transmissive material 34, a light reactive material 35, and a light impermeable material 37. At least a part of the light reactive sheet 40 is made of the light transmissive material 34 and the light reactive material 35, the light reactive material 35 being mixed into the light transmissive material 34. Configurations, functions, and effects of the light reactive sheet 40, which will not be particularly described, are the same as those of the light reactive layer 33, and duplicated descriptions will be omitted. The light reactive sheet 40 of this embodiment changes its physical property (i.e., rigidity) depending on the wavelength of the light directed to the light reactive sheet 40. The light reactive sheet 40 has a plurality of through-holes 40*a* through which the light emitted from the optical film-thickness measuring device passes. Each through-hole 40*a* is surrounded with the light impermeable material 37. In FIG. 17, only one through-hole 40*a* is depicted. When the film thickness of the substrate W is not measured using the optical film-thickness measuring device, the light reactive sheet 40 may not have the through-holes 40*a* and the light impermeable material 37, and the entire light reactive sheet 40 may be constituted of the light transmissive material 34 and the light reactive material 35.

In this embodiment, the plurality of light sources 43 are arranged so as to be able to direct the light to the entire portion of the light reactive sheet 40 whose physical property is to be changed. In this embodiment, the change in the polishing profile due to the change in the thickness of the polishing pad 30 can be suppressed by changing the physical property (i.e., rigidity) of the light reactive sheet 40 according to the thickness or the physical property (i.e., rigidity) of the polishing pad 30. In this embodiment, as with the embodiments described with reference to in FIGS. 9A to 9F, the light reactive material 35 may be distributed such that the light reactive material 35 is located in a desired region. For example, the light reactive material 35 may be distributed in a biased manner toward a polishing-pad facing surface 40*b* of the light reactive sheet 40, or toward a table facing surface 40*c* of the light reactive sheet 40. The polishing-pad facing surface 40*b* faces the polishing pad 30, and the table facing surface 40*c* faces the polishing table 2. The light reactive material 35 may be distributed in the central region of the light reactive sheet 40 in a thickness direction of the light reactive sheet 40. Alternatively, the light reactive material 35 may be distributed at a region located below the periphery of the substrate W during polishing of the substrate W, and may be distributed at a region located below the central portion of the substrate W during polishing of the substrate W. The configurations of the embodiments described with reference to FIGS. 12 to 14 can be applied to this embodiment described with reference to FIG. 17.

The light reactive sheet 40 functions to compensate for the reduction in rigidity of the polishing pad 30. The light reactive sheet 40 further functions as a so-called lower layer (i.e., the cushion layer) of the polishing pad. In this embodiment, since the light reactive sheet 40 is placed on the polishing table 2 in addition to the polishing pad 30, it is not necessary to replace the light reactive sheet 40 in conjunction with replacement of the polishing pad 30. Therefore, this embodiment can contribute to cost reduction.

Furthermore, in one embodiment, the light reactive material 35 may be an ultraviolet-curable resin. In this case, the light source 43 may be configured to emit ultraviolet light. When the ultraviolet-curable resin is used as the light reactive material 35, the rigidity of the light reactive material 35 can be controlled by regulating intensity of the ultraviolet light emitted from the light source 43, and an irradiation time of the ultraviolet light. Specifically, at least a part of the light reactive layer 33 or the light reactive sheet 40, i.e., at least a region where the light reactive material 35 is mixed, becomes more rigid (harder) as the intensity of the ultraviolet light directed to the light reactive material 35 increases within a predetermined range (or as the irradiation time of the ultraviolet light increases within a predetermined range). Thus, when the ultraviolet-curable resin is used as the light reactive material 35, the light reactive layer 33 or the light reactive sheet 40 changes its physical property (i.e., rigidity) depending on the intensity of the light (ultraviolet light) directed to the light reactive sheet 40 and/or the irradiation time of the light (ultraviolet light).

According to the embodiments described with reference to FIGS. 1 to 16, at least a part of the polishing pad 30 is made of the light transmissive material 34 and the light reactive material 35 mixed into the light transmissive material 34. The light reactive material 35 is configured to change its state in response to light. As a result, the polishing pad 30 can compensate for the change in the rigidity of the polishing pad 30 caused by the change in the thickness of the polishing pad 30. In addition, according to the above-described embodiments, at least a part of the polishing-pad structure 29 is made of the light transmissive material 34 and the light reactive material 35 mixed into the light transmissive material 34. As a result, the polishing apparatus 1 can compensate for the change in the rigidity of the polishing pad 30 caused by the change in the thickness of the polishing pad 30.

The elevating mechanism (not shown), the polishing-liquid supply nozzle (not shown), the table rotating motor 6, the polishing-head motor 17, the light source(s) 43, the dressing unit 60, and the rigidity measuring device 80 are electrically connected to the operation controller 9. Operations of the elevating mechanism (not shown), the polishing-liquid supply nozzle (not shown), the table rotating motor 6, the polishing-head motor 17, the light source(s) 43, the dressing unit 60, and the rigidity measuring device 80 are controlled by the operation controller 9.

Figure 18:
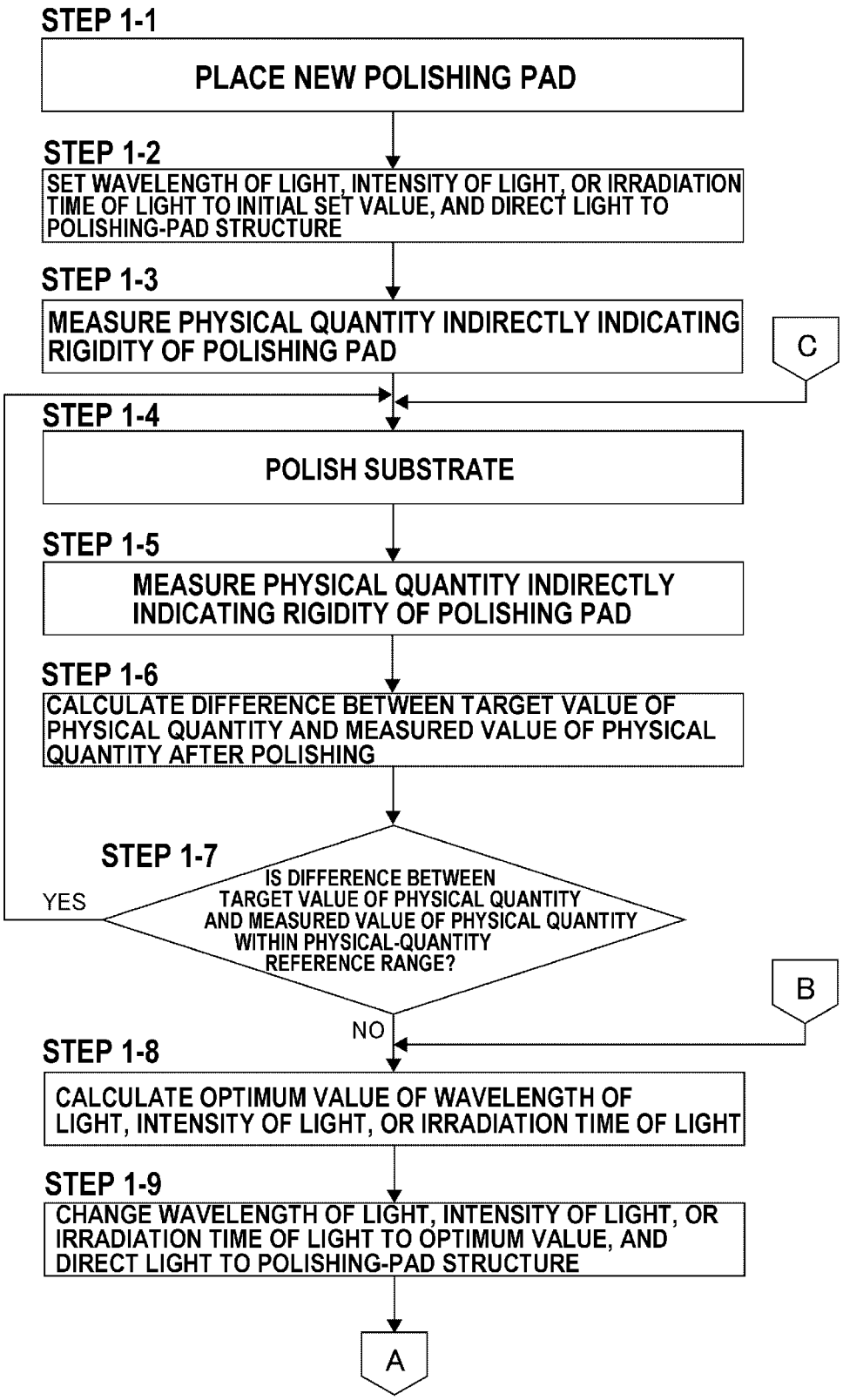
FIG. 18 is a flowchart showing an embodiment of a method of polishing the substrate with changing a physical property of the polishing-pad structure.
Figure 19:
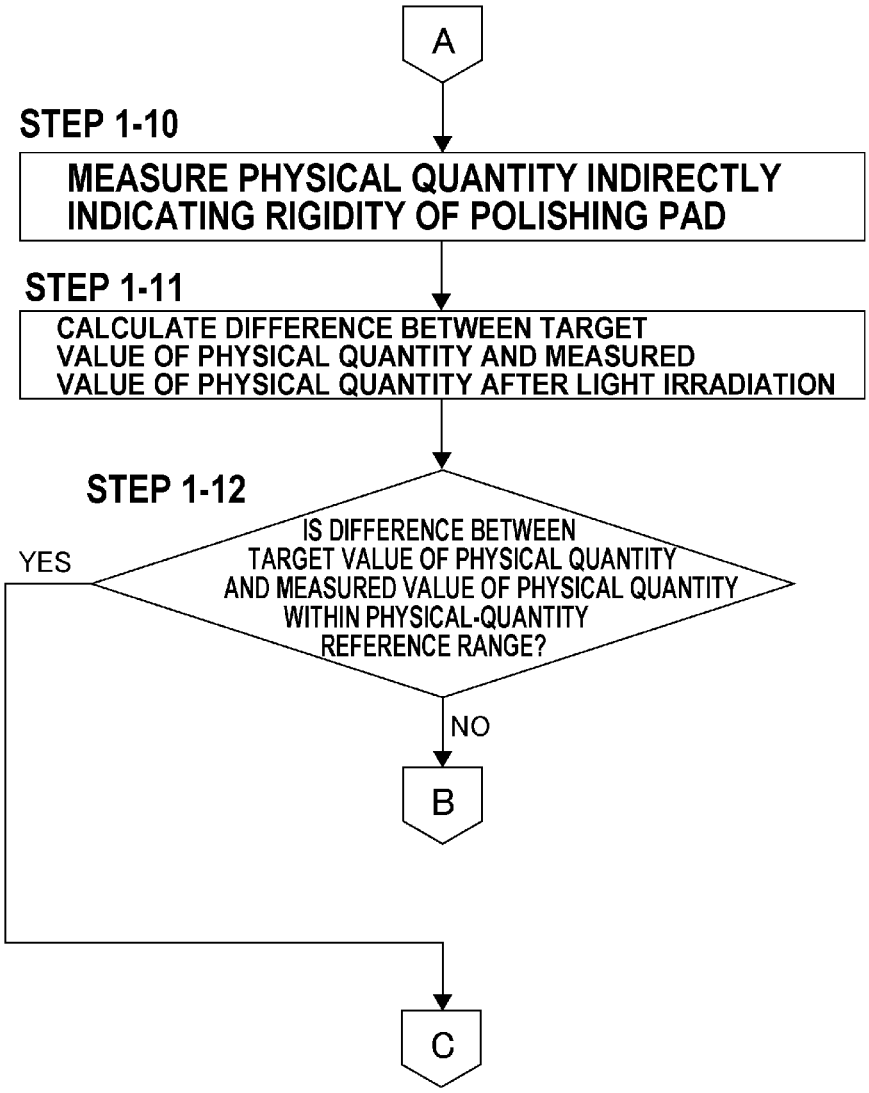
FIG. 19 is a flowchart showing an embodiment of the method of polishing the substrate with changing a physical property of the polishing-pad structure.

Next, an embodiment of a method of polishing the substrate W with changing the physical property of the polishing-pad structure 29 will be described with reference to flowcharts in FIGS. 18 and 19. In this embodiment, a case where the light reversible material is used as the light reactive material 35 will be mainly described.

In step 1-1, a new (unused) polishing pad 30 is placed on the polishing table 2 (or on the light reactive sheet 40 on the polishing table 2).

In step 1-2, a wavelength of light emitted from the light source(s) 43 (a wavelength of the light source(s) 43) is set to an initial set value, and the light source(s) 43 directs light having a predetermined wavelength to the polishing-pad structure 29 for a predetermined time. Therefore, a physical property of at least a part of the polishing-pad structure 29 (the light reactive layer 33 or the light reactive sheet 40) is changed. When an ultraviolet-curable resin is used as the light reactive material 35, the wavelength of the light source(s) 43 is fixed to a wavelength in the range of ultraviolet light, an intensity of the light emitted from the light source(s) 43 or the irradiation time of the light directed to the polishing-pad structure 29 is set to an initial set value, and the light as the ultraviolet light is directed to the polishing-pad structure 29 for a predetermined time.

In step 1-3, a physical quantity indirectly indicating the rigidity of the polishing pad 30 (specifically, the rigidity of the polishing layer 31, and more specifically the rigidity of the light reactive layer 33 in the embodiments of FIGS. 15 and 16) is measured. In this embodiment, the physical quantity is the size of the deformed region of the polishing pad 30 created by the pad pressing mechanism 81. The higher the rigidity of the polishing layer 31 of the polishing pad 30 (the light reactive layer 33 in the embodiments of FIGS. 15 and 16), the larger the size of the deformed region of the polishing pad 30. Furthermore, the size of the deformed region of the polishing pad 30 changes due to the change in the rigidity of the light reactive sheet 40 or the light reactive layer 33. Therefore, the physical quantity indirectly indicating the rigidity of the polishing pad 30 can also be referred to be a physical quantity indirectly indicating the rigidity of the polishing-pad structure 29. In one embodiment, a correlation between the size of the deformed region of the polishing pad 30 and a magnitude of the rigidity of the polishing pad 30 is represented by a linear function. The physical quantity is measured by the rigidity measuring device 80. The physical quantity measured in the step 1-3 is a value of the physical quantity indirectly indicating the rigidity of the polishing pad 30 when the polishing-pad structure 29 is irradiated with the light for a predetermined time under the condition set in the step 2-1. The condition set in the step 2-1 is such that the wavelength of the light, the intensity of the light, or the irradiation time of the light has the initial set value. The physical quantity measured in the step 1-3 is a target value of the physical quantity. In this embodiment, the substrate W is polished while the rigidity of the polishing-pad structure 29 is maintained in an initial condition, i.e., the physical quantity is maintained near the target value.

In one embodiment, the step 1-3 may not be performed. In this case, the operation controller 9 may determine the target value of the physical quantity based on the correlation between the wavelength of the light, the intensity of the light, or the irradiation time of the light and the physical quantity.

Figure 20:
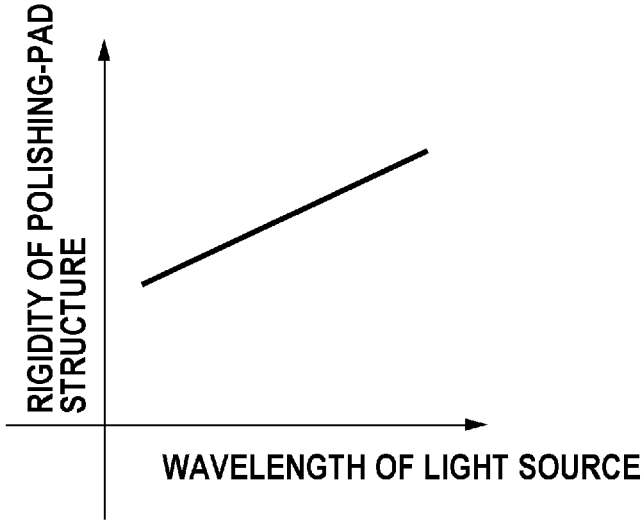
FIG. 20 is a diagram showing an example of a correlation between a rigidity of the polishing-pad structure and a wavelength of light emitted from the light source.

The operation controller 9 instructs each component of the polishing apparatus 1 to polish the substrate W by the method described above (step 1-4). After termination of the polishing, a physical quantity indirectly indicating the rigidity of the polishing pad 30 is measured (step 1-5). In step 1-6, a difference between the target value of the physical quantity indirectly indicating the rigidity of the polishing pad 30 and the measured value of the physical quantity after termination of the polishing (i.e., the physical quantity measured in the step 1-5) is calculated. In step 1-7, the operation controller 9 compares the difference with a predefined physical-quantity reference range. When the difference is out of the physical-quantity reference range, the operation controller 9 calculates an optimum value of the wavelength of the light source(s) 43 based on the correlation between the physical quantity and the wavelength of the light source(s) 43 (step 1-8). FIG. 20 is a diagram showing an example of the correlation between the rigidity of the polishing-pad structure 29 and the wavelength of the light emitted from the light source(s) 43.

When the ultraviolet-curable resin is used as the light reactive material 35, an optimum value of the intensity of the light emitted from the light source(s) 43 or an optimum value of the irradiation time of the light is calculated based on a correlation between the physical quantity and the intensity of the light (i.e., ultraviolet light) emitted from the light source(s) 43, or a correlation between the physical quantity and the irradiation time of the light directed to the polishing-pad structure 29. Each correlation described above is stored as a database in the memory 9*a* of the operation controller 9 in advance. In one embodiment, the intensity (or the irradiation time) of the ultraviolet light and the magnitude of the rigidity of the polishing-pad structure 29 are in a proportional relationship as shown in FIG. 20. The optimum value of the wavelength of the ultraviolet light, the intensity of the ultraviolet light, or the irradiation time of the ultraviolet light is a value of the wavelength of the ultraviolet light, the intensity of the ultraviolet light, or the irradiation time of the ultraviolet light when the physical quantity is the target value based on each correlation described above.

In step 1-9, the operation controller 9 changes the wavelength of the light emitted from the light source(s) 43 to the optimum value calculated in the step 1-8, and causes the light source(s) 43 to direct the light to the polishing-pad structure 29 for a predetermined time. Therefore, a physical property of at least a part of the polishing-pad structure 29 (i.e., the light reactive layer 33 or the light reactive sheet 40) is changed. When the ultraviolet-curable resin is used as the light reactive material 35, the operation controller 9 changes the intensity of the light emitted from the light source(s) 43 or the irradiation time of the light to the optimum value calculated in the step 1-8. After the light is directed to the polishing-pad structure 29 for the predetermined time under the changed condition, a physical quantity indirectly indicating the rigidity of the polishing pad 30 is measured (step 1-10). In step 1-11, a difference between the target value of the physical quantity indirectly indicating the rigidity of the polishing pad 30 and the measured value of the physical quantity after directing the light to the polishing-pad structure 29 (i.e., the physical quantity measured in the step 1-10) is calculated. In step 1-12, the operation controller 9 compares the difference between the target value of the physical quantity and the measured value of the physical quantity after the light is directed to the polishing-pad structure 29 with a predefined physical-quantity reference range.

When the difference between the target value of the physical quantity and the measured value of the physical quantity is out of the physical-quantity reference range, the steps 1-8 to 1-12 are repeated again. When the difference between the target value of the physical quantity and the measured value of the physical quantity is within the physical-quantity reference range, a new substrate is polished (the processing flow returns to the step 1-4). The steps 1-5 to 1-12 may be performed at the end of each polishing, or may be performed each time a predetermined number of substrates are polished. In one embodiment, a new substrate may be polished after the step 1-9 (the processing flow may return to the step 1-4).

According to the above-described method, the difference between the target value of the physical quantity and the measured value of the physical quantity after termination of the polishing is controlled such that the difference falls within the physical-quantity reference range even when the thickness of the polishing pad 30 changes due to polishing or dressing and the rigidity of the polishing pad 30 changes. As a result, the change in the rigidity of the polishing pad 30 caused by the change in the thickness of the polishing pad 30 can be compensated, so that the substrate W can be polished while the change in polishing profile due to the change in thickness of the polishing pad 30 is suppressed.

In one embodiment, the thickness of the polishing pad 30, the number of processed substrates (the number of polished substrates), or an accumulated time of dressing may be used as the physical quantity indirectly indicating the rigidity of the polishing pad 30. The rigidity of the polishing pad 30 changes depending on the thickness of the polishing pad 30, and the thickness of the polishing pad 30 changes due to polishing of the substrate or dressing of the polishing pad 30. Specifically, the thickness of the polishing pad 30 becomes thinner and the rigidity of the polishing pad 30 (i.e., the rigidity of the polishing-pad structure 29) decreases as the number of processed substrates increases or the accumulated time of dressing increases. In one embodiment, the thickness of the polishing pad 30 and the rigidity of the polishing-pad structure 29 are in a proportional relationship. A correlation between the number of processed substrates or the accumulated time of dressing and the rigidity of the polishing-pad structure 29 is represented by a linear function having a negative slope. Therefore, these physical quantities indirectly indicate the rigidity of the polishing-pad structure 29. The thickness of the polishing pad 30 is measured by the above-described thickness measuring device. The operation controller 9 is configured to measure the accumulated time of dressing each time the polishing pad is replaced. The operation controller 9 is further configured to count the number of processed substrates each time the polishing pad is replaced. The number of processed substrates and the accumulated time of dressing is measured by the operation controller 9.

Figure 21A:
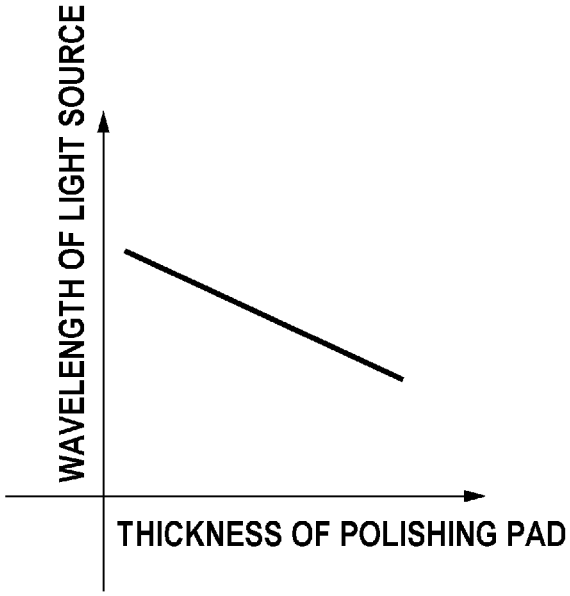
FIG. 21A is a diagram showing an example of a correlation between a thickness of the polishing pad and a wavelength of light emitted from the light source.
Figure 21B:
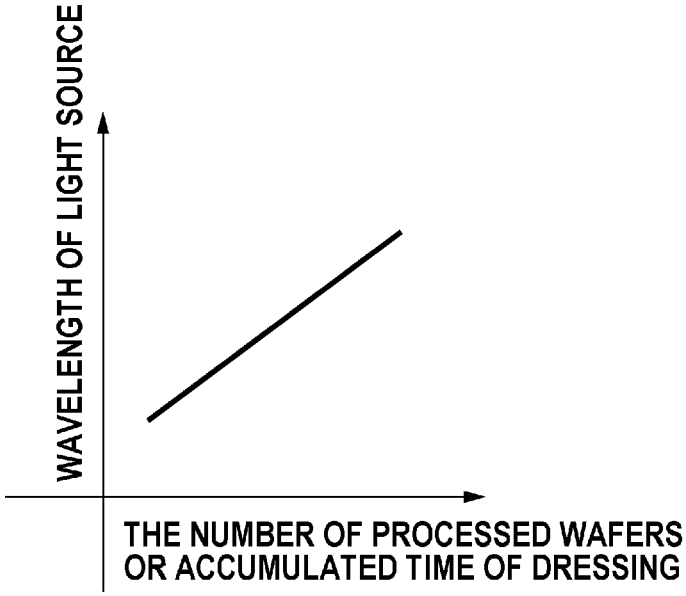
FIG. 21B is a diagram showing an example of a correlation between the number of processed wafers as substrates or an accumulated time of dressing and the wavelength of light emitted from the light source.

A polishing method when the thickness of the polishing pad 30, the number of processed substrates, or the accumulated time of dressing is measured as the physical quantity is the same as the polishing method in the above-described steps 1-1 to 1-12 except for the physical quantity to be measured. FIG. 21A is a diagram showing an example of a correlation between the thickness of the polishing pad 30 and the wavelength of the light emitted from the light source(s) 43, and FIG. 21B is a diagram showing an example of a correlation between the number of processed wafers as substrates or the accumulated time of dressing and the wavelength of the light emitted from the light source(s) 43. The wavelength of the light emitted from the light source(s) 43 shown in FIGS. 21A and 21B indicates the wavelength for the physical quantity to achieve the target value when the thickness of the polishing pad 30, the number of processed substrates, or the accumulated time of dressing is a value on horizontal axes of the diagrams.

Figure 22:
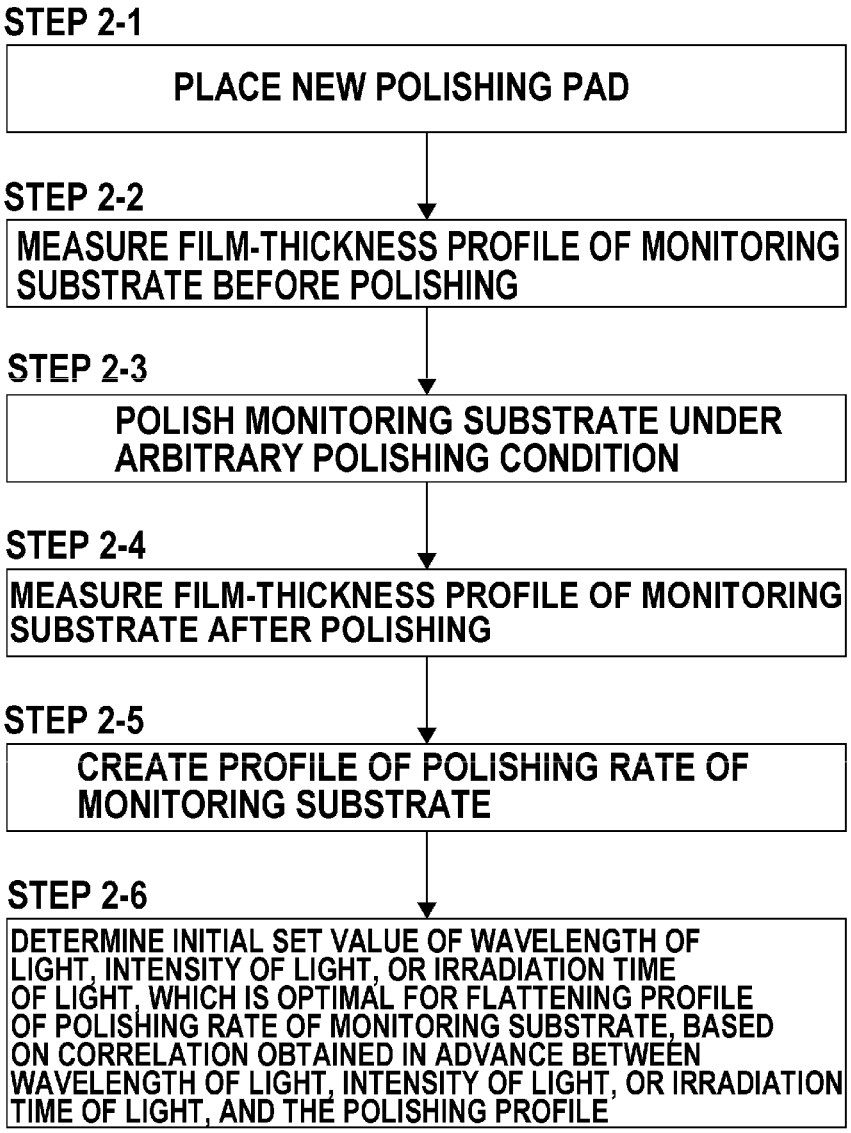
FIG. 22 is a flowchart showing an embodiment of a determining method for an initial set value of a wavelength of light, an intensity of light, or an irradiation time of light.

Next, an embodiment of a method of determining the initial set value of the wavelength of the light, the intensity of the light, or the irradiation time of the light in the step 1-2 will be described with reference to a flowchart in FIG. 22. In step 2-1, a new (unused) polishing pad 30 is placed on the polishing table 2 (or on the light reactive sheet 40 on the polishing table 2). In step 2-2, a film-thickness profile of a monitoring substrate before polishing is measured by a film-thickness measuring device 90 (see FIG. 1). The monitoring substrate has the same structure as the substrate W to be polished in the above-described step 1-7.

The film-thickness measuring device 90 is configured to be able to measure a film-thickness profile of a substrate. The film-thickness measuring device 90 may be a film-thickness measuring device including an eddy-current sensor or an optical sensor. The film-thickness measuring device 90 is electrically connected to the operation controller 9, and operations of the film-thickness measuring device 90 are controlled by the operation controller 9. The film-thickness measuring device 90 may be disposed inside the polishing apparatus 1 or may be disposed outside the polishing apparatus 1. The substrate is transferred between the polishing apparatus 1 and the film-thickness measuring device 90 by a not-shown transfer robot. The transfer robot is electrically connected to the operation controller 9, and operations of the transfer robot are controlled by the operation controller 9.

In step 2-3, the monitoring substrate is polished under arbitrary polishing conditions (including the pressures in the pressure chambers C1 to C5, etc.). In step 2-4, a film-thickness profile of the monitoring substrate after polishing is measured by the film-thickness measuring device 90. In step 2-5, a profile of a polishing rate of the monitoring substrate is created from the film-thickness profile of the monitoring substrate before polishing and the film-thickness profile of the monitoring substrate after polishing.

In step 2-6, an initial set value of a wavelength of the light, an intensity of the light, or an irradiation time of the light, which is optimal for flattening the profile of the polishing rate of the monitoring substrate obtained in the step 2-5, is determined. The initial set value is determined based on a correlation between the wavelength of the light and the polishing profile (or a correlation between the intensity of the light and the polishing profile, or a correlation between the irradiation time of the light and the polishing profile) that has been obtained in advance. For example, the initial set value of the wavelength of the light, the intensity of the light, or the irradiation time of the light is determined such that a position from the center of the substrate where the amount of change in the polishing rate of the substrate per unit pressure of the retainer ring 20 is the largest obtained in advance coincides with a position from the center of the periphery of the monitoring substrate where the polishing rate needs to be adjusted the most. The correlation between the wavelength of the light and the polishing profile, the correlation between the intensity of the light and the polishing profile, and the correlation between the irradiation time of the light and the polishing profile are stored as a database in the memory 9*a* of the operation controller 9 in advance.

Figure 23:
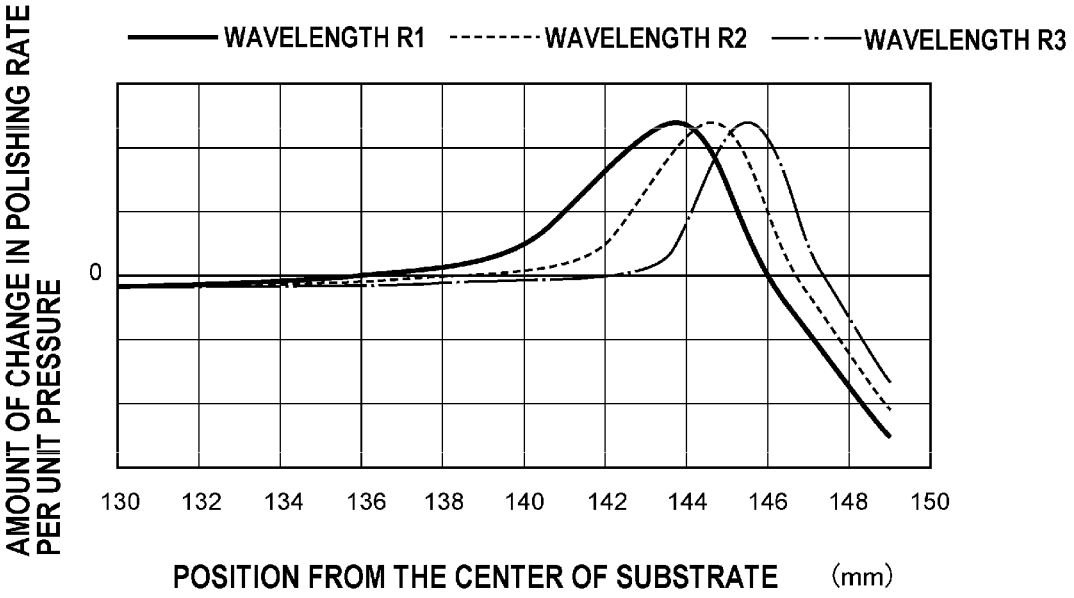
FIG. 23 is a graph showing an example of a plurality of polishing profiles with different wavelengths.

FIG. 23 is a graph showing an example of a plurality of polishing profiles with different wavelengths. FIG. 23 shows respective polishing profiles when substrates are polished with the polishing-pad structure 29 irradiated with light having wavelengths R1, R2, and R3. For example, a position from the center of the substrate where the amount of change in the polishing rate of the substrate per unit pressure of the retainer ring 20 is the largest when the substrate is polished with the polishing pad of the polishing-pad structure 29, which is irradiated with light having the wavelength R2, is approximately 145 mm.

The polishing profile corresponding to the wavelength of the light, the intensity of the light, or the irradiation time of the light determined in the step 2-6 is an optimum polishing profile for obtaining a flat film-thickness profile. In other words, processes in the steps 1-1 to 1-12 are processes of polishing the substrate W while the wavelength of the light, the intensity of the light, or the irradiation time of the light is changed according to wear of the polishing pad 30 in order to keep this optimum polishing profile.

Figure 24:
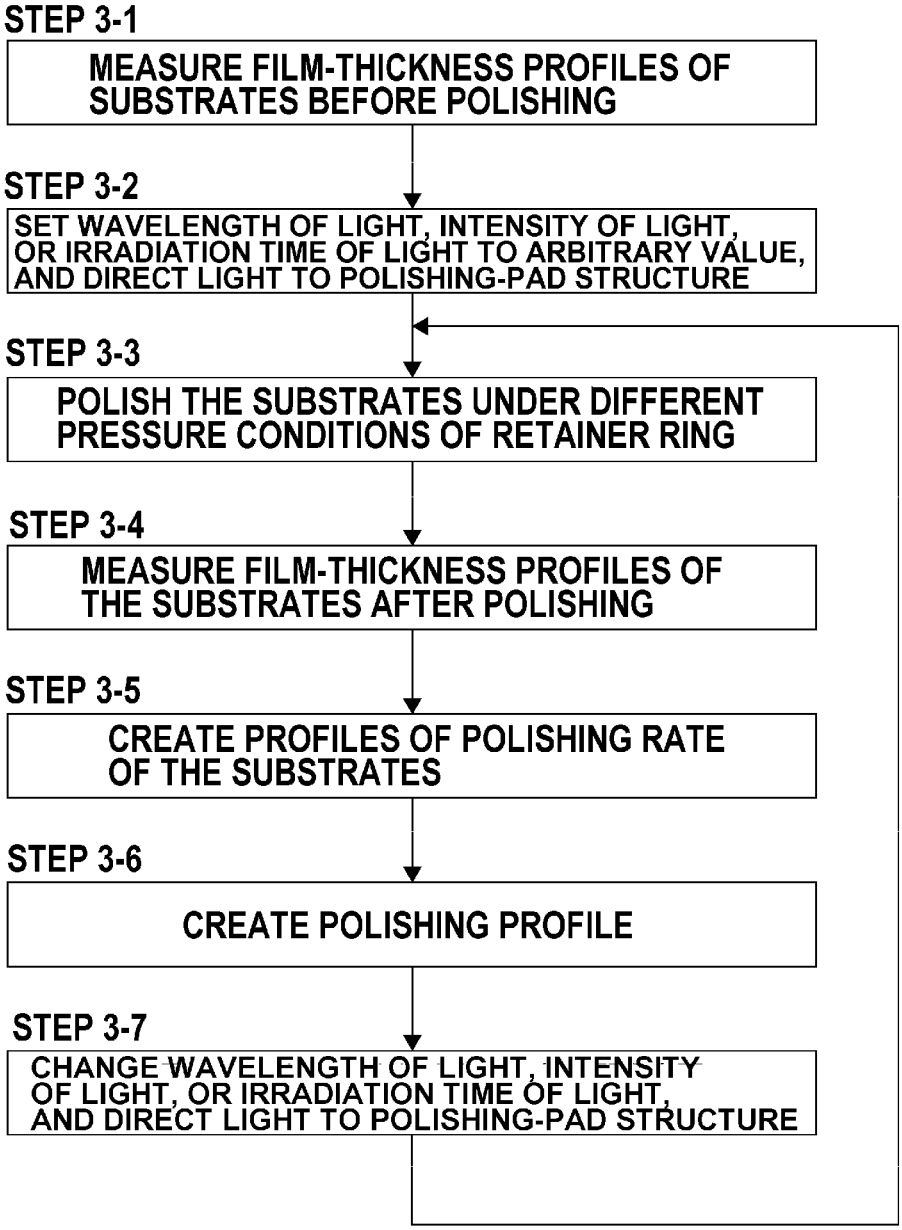
FIG. 24 is a flowchart showing an embodiment of a creating method for a correlation between a wavelength of light, an intensity of light, or an irradiation time of light and the polishing profile.
Figure 25A:
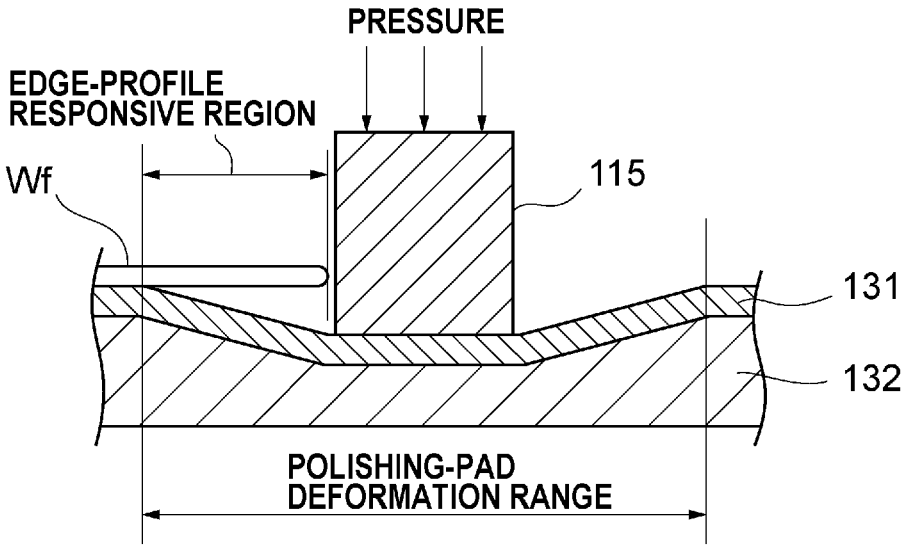
FIG. 25A is a diagram illustrating a conventional polishing pad when being pressed by a retainer ring while a substrate is polished.
Figure 25B:
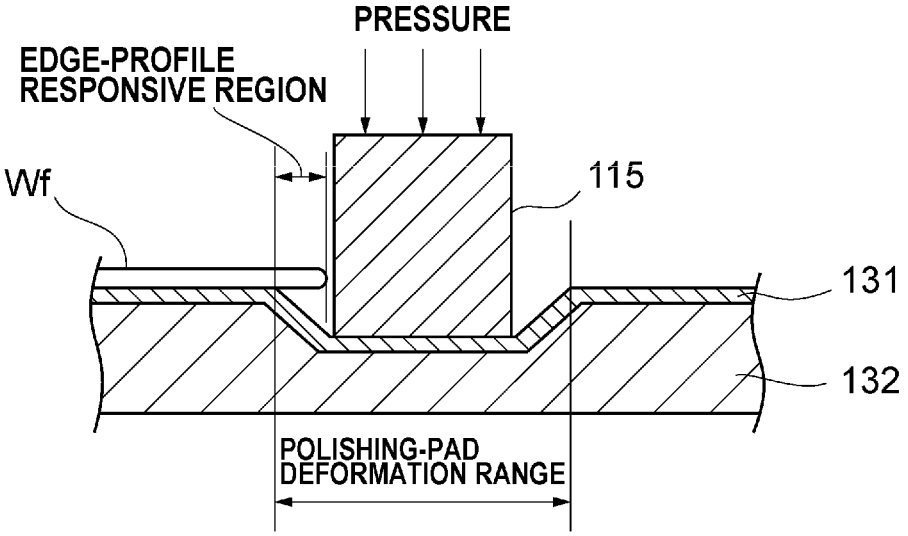
FIG. 25B is a diagram illustrating the conventional polishing pad when being pressed by the retainer ring while the substrate is polished.
Figure 26A:
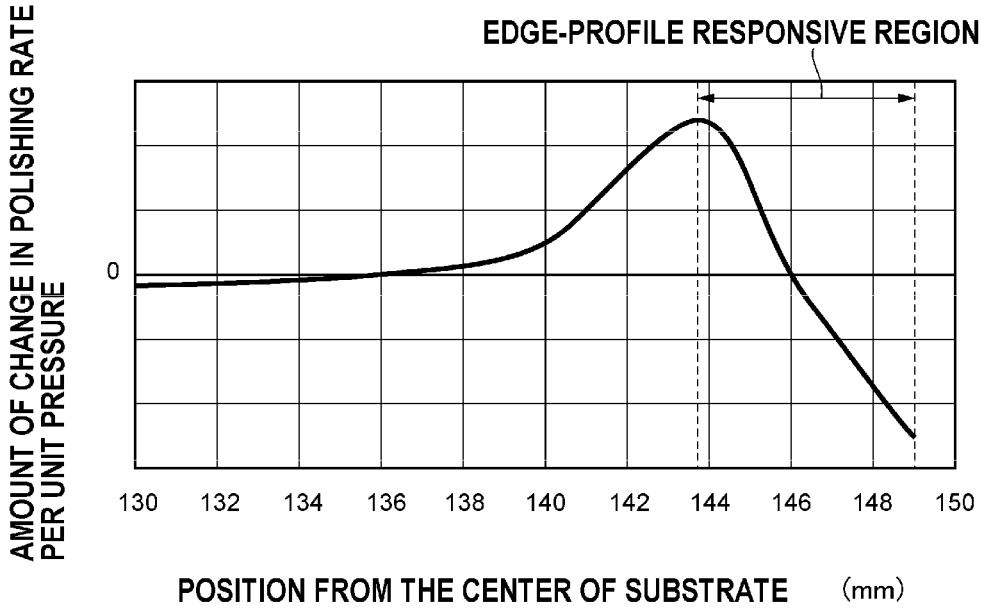
FIG. 26A is a graph showing a polishing profile when the substrate is polished with the polishing pad shown in FIG. 25A.
Figure 26B:
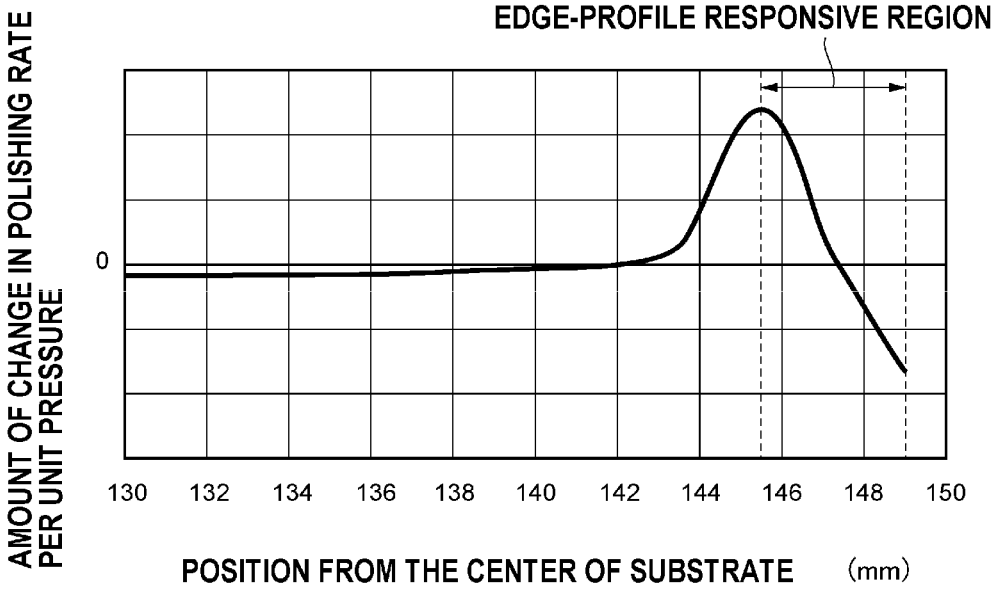
FIG. 26B is a graph showing a polishing profile when the substrate is polished with the polishing pad shown in FIG. 25B.

Next, an embodiment of a method of creating the correlation between the wavelength of the light, the intensity of the light, or the irradiation time of the light and the polishing profile will be described with reference to a flowchart in FIG. 24. In step 3-1, film-thickness profiles of a plurality of substrates before polishing are measured by the film-thickness measuring device 90.

In step 3-2, the wavelength of the light emitted from the light source(s) 43 is set to an arbitrary value, and the light having the predetermined wavelength is directed from the light source(s) 43 to the polishing-pad structure 29 for a predetermined time. When an ultraviolet-curable resin is used as the light reactive material 35, the wavelength of the light emitted from the light source(s) 43 is fixed to a wavelength in a range of the ultraviolet light, and the intensity of the light emitted from the light source(s) 43 or the irradiation time of the light to be directed to the polishing-pad structure 29 is set to an arbitrary value. The light, which is the ultraviolet light, is then directed to the polishing-pad structure 29 for a predetermined time.

In step 3-3, the plurality of substrates are polished under different pressure conditions of the retainer ring, respectively. In step 3-4, film-thickness profiles of the plurality of substrates after polishing are measured by the film-thickness measuring device 90. In step 3-5, profiles of polishing rate of the plurality of substrates are created from the film-thickness profiles of the plurality of substrates before polishing and the film-thickness profiles of the plurality of substrates after polishing.

In step 3-6, a polishing profile is created. Specifically, the polishing profile is created by determining slopes of a linear approximation of the pressure of the retainer ring and the polishing rate for measurement points on the substrate in the profiles of the polishing rate created in the step 3-5, and plotting the slopes to create a profile.

In step 3-7, the wavelength of the light, the intensity of the light, or the irradiation time of the light is changed, and the light is directed to the polishing-pad structure 29 for a predetermined time. After completion of the step 3-7, the steps 3-3 to 3-6 are repeated. In this way, the plurality of polishing profiles corresponding to a plurality of wavelengths of the light, a plurality of intensities of the light, or a plurality of irradiation times of the light are created, and a correlation between the wavelength of the light, the intensity of the light, or the irradiation time of the light and the polishing profile is created. In one embodiment, a polishing profile for a wavelength of the light (an intensity of the light, or an irradiation time of the light) in region where data has not been obtained may be created by linearly interpolating data for an adjacent wavelength of the light (an adjacent intensity of the light, or an adjacent irradiation time of the light).

A program for causing the operation controller 9 to perform the above-described steps is stored in a non-transitory tangible computer-readable storage medium, and the program is provided to the operation controller 9 via the storage medium.

The previous description of embodiments is provided to enable a person skilled in the art to make and use the present invention. Moreover, various modifications to these embodiments will be readily apparent to those skilled in the art, and the generic principles and specific examples defined herein may be applied to other embodiments. Therefore, the present invention is not intended to be limited to the embodiments described herein but is to be accorded the widest scope as defined by limitation of the claims.

INDUSTRIAL APPLICABILITY

The present invention is applicable to a polishing pad and a polishing apparatus for use in polishing of a substrate, such as a wafer. Further, the present invention is applicable to a method of polishing a substrate, such as a wafer.

REFERENCE SIGNS LIST

1 polishing apparatus
2 polishing table
3 table body
4 support plate
5 table shaft
6 table rotating motor
9 operation controller
10 polishing head
11 head body
12 polishing-head shaft
14 support shaft
16 polishing-head oscillation arm
17 polishing-head motor
18 membrane
20 retainer ring
22 retainer-ring pressing mechanism
23 piston
24 rolling diaphragm
25 rotary joint
29 polishing-pad structure
30 polishing pad
31 polishing layer
32 cushion layer
33 light reactive layer
34 light transmissive material
35 light reactive material
37 light impermeable material
40 light reactive sheet
43 light source
48 light source
51 light shielding cover
53 shield layer
60 dressing unit
61 dresser
62 dresser shaft
64 air cylinder
66 dresser oscillation arm
68 column
69 support base
70 support shaft
72 dresser displacement sensor
73 target plate
74 sensor holder
80 rigidity measuring device
81 pad pressing mechanism
83 profile measuring device
85 air cylinder
86 light emitting section
87 pressing rod
88 support base
89 light receiving section
90 film-thickness measuring device

The invention claimed is:

1. A polishing pad having a polishing surface for polishing a substrate, comprising:

a light transmissive material; and a light reactive material mixed into the light transmissive material, at least a part of the polishing pad being made of the light transmissive material and the light reactive material; and a light reactive layer having a physical property that changes in response to light, at least a part of the light reactive layer being made of the light transmissive material and the light reactive material.

2. The polishing pad according to claim 1, wherein the light reactive material is configured to reversibly change its state depending on a wavelength of light directed to the light reactive material.

3. The polishing pad according to claim 1, wherein the light reactive material comprises an ultraviolet-curable resin.

4. The polishing pad according to claim 1, wherein the light transmissive material is configured to be able to pass light having a wavelength in a range from a wavelength of ultraviolet light to a wavelength of visible light.

5. The polishing pad according to claim 1, wherein the light transmissive material comprises resin including a base material which is one or a mixture of two or more of acrylic resin, polyethylene terephthalate, polycarbonate, olefin resin, fluorine resin, nylon, and polyurethane.

6. The polishing pad according to claim 1, further comprising a polishing layer having the polishing surface, the light reactive layer being coupled to the polishing layer.

7. The polishing pad according to claim 1, further comprising a cushion layer having a plurality of through-holes formed therein, the cushion layer being coupled to the light reactive layer.

8. The polishing pad according to claim 1, further comprising a cushion layer, wherein the light reactive layer has the polishing surface, and the cushion layer is coupled to the light reactive layer.

9. The polishing pad according to claim 8, wherein the light reactive layer has a first light-transmissive surface facing away from the polishing surface, and the light reactive material is distributed in a central region in a thickness direction of the light reactive layer or distributed in a biased manner toward the first light-transmissive surface.

10. A polishing apparatus for polishing a substrate, comprising:

a polishing-pad structure;

a polishing table configured to support the polishing-pad structure;

a polishing head configured to press the substrate against the polishing-pad structure; and a light source configured to emit light to the polishing-pad structure, wherein the polishing-pad structure includes a polishing pad having a polishing surface for polishing the substrate, at least a part of the polishing-pad structure is made of a light transmissive material and a light reactive material, the light reactive material being mixed into the light transmissive material, and the polishing-pad structure further includes a light reactive sheet configured to change its physical property in response to light, and at least a part of the light reactive sheet is made of the light transmissive material and the light reactive material.

11. The polishing apparatus according to claim 10, at least a part of the polishing pad is made of the light transmissive material and the light reactive material.

12. The polishing apparatus according to claim 10, wherein the light reactive material is configured to reversibly change its state depending on a wavelength of light directed to the light reactive material.

13. The polishing apparatus according to claim 10, wherein the light reactive material comprises an ultraviolet-curable resin.

14. The polishing apparatus according to claim 10, wherein the light source is configured to be able to change a wavelength of the light in at least a range of a wavelength of ultraviolet light to a wavelength of visible light, or the light source is configured to emit ultraviolet light.

15. The polishing apparatus according to claim 10, wherein the light source is disposed in the polishing table or above the polishing table.

16. The polishing apparatus according to claim 10, wherein the polishing table includes a support plate configured to support the polishing-pad structure, and the support plate is made of transparent ceramic or quartz glass.

17. The polishing apparatus according to claim 10, wherein a part of the polishing apparatus is covered with a coating layer that blocks or absorbs ultraviolet light.

18. The polishing apparatus according to claim 17, wherein the coating layer contains an ultraviolet blocking agent, and the ultraviolet blocking agent comprises carbon black or inorganic pigment.

19. The polishing apparatus according to claim 10, further comprising a rigidity measuring device configured to measure a rigidity of the polishing pad.

20. The polishing apparatus according to claim 10, further comprising a thickness measuring device configured to measure a thickness of the polishing pad.

21. The polishing apparatus according to claim 10, further comprising an operation controller configured to count the number of processed substrates after replacement of the polishing pad.

22. A polishing method comprising:

setting a wavelength of light, an intensity of light, or an irradiation time of light to an initial set value, and directing the light, emitted by a light source, to a polishing-pad structure having a polishing pad for polishing a substrate, at least a part of the polishing-pad structure being made of a light transmissive material and a light reactive material, the light reactive material being mixed into the light transmissive material, the polishing-pad structure being supported by a polishing table;

pressing the substrate by a polishing head against a polishing surface of the polishing pad while independently rotating the polishing head and the polishing table to polish the substrate;

measuring a physical quantity indirectly indicating a rigidity of the polishing pad after termination of the polishing;

calculating a difference between a target value of the physical quantity and a measured value of the physical quantity;

comparing the difference with a predefined physical-quantity reference range;

when the difference is out of the physical-quantity reference range, calculating an optimum value of the wavelength of the light, the intensity of the light, or the irradiation time of the light based on a correlation between the physical quantity and one of the wavelength of the light, the intensity of the light, and the irradiation time of the light, and changing the wavelength of the light, the intensity of the light, or the irradiation time of the light to the optimum value; and when the physical quantity is within the physical-quantity reference range, polishing the substrate, wherein the target value of the physical quantity is a value of the physical quantity when the light is directed to the polishing-pad structure under a condition that the wavelength of the light, the intensity of the light, or the irradiation time of the light has the initial set value.

23. The polishing method according to claim 22, wherein the physical quantity is a size of a deformed region of the polishing pad created by a pad pressing mechanism, a thickness of the polishing pad, the number of processed substrates, or an accumulated time of dressing.

24. The polishing method according to claim 22, further comprising:

creating a profile of a polishing rate of a monitoring substrate; and determining the initial set value of the wavelength of the light, the intensity of the light, or the irradiation time of the light which is optimal for flattening the profile of the polishing rate of the monitoring substrate based on a correlation between a wavelength and a polishing profile, a correlation between an intensity of light and a polishing profile, or a correlation between an irradiation time of light and a polishing profile obtained in advance.

* * * * *